US009658578B2

(12) United States Patent
Matsuda et al.

(10) Patent No.: US 9,658,578 B2
(45) Date of Patent: May 23, 2017

(54) TRANSFER DEVICE AND IMAGE FORMING APPARATUS

(71) Applicants: Hiromichi Matsuda, Kanagawa (JP); Kimiharu Yamazaki, Kanagawa (JP); Takafumi Seki, Kanagawa (JP); Jun Yamane, Kanagawa (JP)

(72) Inventors: Hiromichi Matsuda, Kanagawa (JP); Kimiharu Yamazaki, Kanagawa (JP); Takafumi Seki, Kanagawa (JP); Jun Yamane, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/001,360

(22) Filed: Jan. 20, 2016

(65) Prior Publication Data

US 2016/0216649 A1 Jul. 28, 2016

(30) Foreign Application Priority Data

Jan. 23, 2015 (JP) ..... 2015-011633
Jul. 3, 2015 (JP) ..... 2015-134777

(51) Int. Cl.
*G03G 15/16* (2006.01)
*G03G 15/01* (2006.01)

(52) U.S. Cl.
CPC ..... *G03G 15/1615* (2013.01); *G03G 15/0136* (2013.01)

(58) Field of Classification Search
CPC ..... G03G 15/1615; G03G 15/0136
See application file for complete search history.

(56) References Cited

U.S. PATENT DOCUMENTS 6,941,096 B2 9/2005 Matsuda et al.
6,996,357 B2 2/2006 Matsuda et al.
(Continued)

FOREIGN PATENT DOCUMENTS

JP 2005-164678 6/2005
JP 2008-304801 12/2008
(Continued)

OTHER PUBLICATIONS

Extended European Search Report dated May 24, 2016 issued in corresponding European Application No. 16152273.5.

*Primary Examiner* — Sandra Brase
(74) *Attorney, Agent, or Firm* — Harness, Dickey & Pierce, P.L.C.

(57) ABSTRACT

A transfer device includes a belt image bearer; a driving roller that rotates the belt image bearer; a transfer member; first and second driving motors that respectively rotate the driving roller and the transfer member; first and second speed detecting units that respectively detect rotational speeds of the belt image bearer and the transfer member; and a control unit that implements control such that the belt image bearer and the transfer member are rotated at rotational speeds corresponding to a relative speed at which a variation amount is less than a predetermined variation amount, the variation amount being the variation of values of driving torques of the first and second driving motors in a state where the belt image bearer and the transfer member are in contact, with respect to these values in a state where the belt image bearer and the transfer member are separated.

18 Claims, 25 Drawing Sheets

(56) References Cited

U.S. PATENT DOCUMENTS

| | | | | |
|---|---|---|---|---|
| 7,327,972 | B2 | 2/2008 | Matsuda et al. | |
| 7,343,119 | B2 | 3/2008 | Matsuda et al. | |
| 7,454,150 | B2 | 11/2008 | Matsuda et al. | |
| 7,587,157 | B2 | 9/2009 | Matsuda et al. | |
| 7,684,740 | B2 | 3/2010 | Matsuda et al. | |
| 7,848,689 | B2 | 12/2010 | Matsuda et al. | |
| 7,885,587 | B2 | 2/2011 | Matsuda et al. | |
| 8,000,622 | B2 | 8/2011 | Ishizaki et al. | |
| 8,059,998 | B2 | 11/2011 | Koike | |
| 8,081,905 | B2 | 12/2011 | Matsuda | |
| 8,165,502 | B2 | 4/2012 | Matsuda | |
| 8,385,760 | B2 | 2/2013 | Matsuda | |
| 8,428,476 | B2 | 4/2013 | Matsuda et al. | |
| 8,503,910 | B2 | 8/2013 | Matsuda | |
| 8,538,310 | B2 | 9/2013 | Matsuda et al. | |
| 8,588,651 | B2 | 11/2013 | Matsuda et al. | |
| 8,845,472 | B2 | 9/2014 | Matsuda et al. | |
| 9,042,784 | B2 | 5/2015 | Matsuda et al. | |
| 2003/0223768 | A1* | 12/2003 | Takigawa ..... | G03G 15/0131 399/66 |
| 2009/0263158 | A1 | 10/2009 | Murata et al. | |
| 2011/0129241 | A1* | 6/2011 | Tomioka ..... | G03G 15/5008 399/36 |
| 2011/0293307 | A1 | 12/2011 | Ogata et al. | |
| 2013/0260952 | A1 | 10/2013 | Matsuda et al. | |

FOREIGN PATENT DOCUMENTS

| | | |
|---|---|---|
| JP | 2009-009103 | 1/2009 |
| JP | 2011-180565 | 9/2011 |
| JP | 2013-242380 | 12/2013 |

* cited by examiner

TRANSFER DEVICE AND IMAGE FORMING APPARATUS

BACKGROUND OF THE INVENTION

1. Field of the Invention

The present invention relates to a transfer device and an image forming apparatus.

2. Description of the Related Art

Conventionally, there is known a transfer device of an image forming apparatus that forms a transfer nip by a nip forming member that abuts an image bearer, sandwiches the sheet that is a transfer material in the nip, and transfers a toner image on the image bearer onto the sheet. As one example, there is known a secondary transfer device that transfers a superimposed toner image formed on an intermediate transfer belt, onto a sheet. Specifically, first, toner images of different colors are formed on corresponding photoconductive drums, and the toner images are sequentially transferred, by primary transfer, onto the intermediate transfer belt, to form the superimposed toner image. The intermediate transfer belt is a belt image bearer that is rotatably stretched around a plurality of stretching members. Then, the superimposed toner image formed on the intermediate transfer belt is transferred, by secondary transfer, onto the sheet.

In the secondary transfer device, a nip forming member is provided. The nip forming member includes a secondary transfer roller that abuts the front side of the intermediate transfer belt, and a secondary transfer counter roller that is faces the secondary transfer roller and that abuts the back side 1 of the intermediate transfer belt. The secondary transfer counter roller is one of the plurality of stretching members. The secondary transfer roller and the secondary transfer counter roller sandwich the intermediate transfer belt to form a secondary transfer nip. The superimposed toner image formed on the intermediate transfer belt is transferred onto a sheet, which is conveyed to the secondary transfer nip.

In an image forming apparatus provided with the above secondary transfer device, when the movement speed of the intermediate transfer belt varies within one rotation period of the intermediate transfer belt due to variations in the thickness of the intermediate transfer belt, etc., the superimposition position may shift. The superimposition position is where the toner images of different colors are to be superimposed from the plurality of photoconductive drums. Thus, when the superimposition position is shifted, a failure such as color shift may occur.

An image forming apparatus described in Patent Document 1 is provided with a driving roller speed detector for detecting the rotational speed of a driving roller, which is one of the plurality of stretching members for drivingly rotating the intermediate transfer belt, and a belt speed detector for detecting the movement speed of the intermediate transfer belt. Based on the detection results of the driving roller speed detector and the belt speed detector, the rotational speed of the driving roller is adjusted by controlling a driving motor for driving the driving roller, such that the movement speed of the intermediate transfer belt becomes a constant speed.

However, in a conventional secondary transfer device, the rotating shaft of the secondary transfer roller is drivingly rotated at a constant speed by the motor. Therefore, when the roller diameter changes as the surface of the secondary transfer deforms, etc., the surface speed of the secondary transfer roller varies. Furthermore, the secondary transfer roller generates a belt conveying force by contacting the intermediate transfer belt, and therefore when the surface speed of the secondary transfer roller varies, the conveying force of the intermediate transfer belt, which is caused by the secondary transfer roller, also varies.

As described above, when the conveying force of the intermediate transfer belt by the secondary transfer roller varies, a phenomenon occurs, in which the belt part between the driving roller and the secondary transfer roller is pulled and loosened in the intermediate transfer belt rotation direction. When this phenomenon occurs significantly, even by controlling the rotational speed of the driving roller such that the movement speed of the intermediate transfer belt becomes constant, it is difficult to control the movement speed of the intermediate transfer belt with high precision.

That is, when the surface speed of the secondary transfer roller increases, and the conveying amount of the intermediate transfer belt by the secondary transfer roller increases, the intermediate transfer belt is pulled with respect to the driving roller and the belt tension increases, the conveying load on the driving roller is decreased, and the conveying torque of the driving roller is decreased. In this state, even by slightly increasing the turning force of the driving roller, the conveying amount of the intermediate transfer belt becomes excessively large. Accordingly, it becomes difficult to finely adjust the movement speed of the intermediate transfer belt, and it becomes difficult to control the movement speed of the intermediate transfer belt with high precision by controlling the rotational speed of the driving roller.

Meanwhile, when the surface speed of the secondary transfer roller decreases, and the conveying amount of the intermediate transfer belt decreases, the intermediate transfer belt is loosened with respect to the driving roller and the belt tension decreases, and the conveying load on the driver roller increases, and the conveying torque of the driving roller increases. In this state, when the conveying torque of the driving torque extremely increases, slipping is caused between the driving roller surface and the intermediate transfer belt, and the conveying amount of the intermediate transfer belt by the driving roller decreases. Therefore, a conveying failure of the intermediate transfer belt by the driving roller occurs, and therefore it becomes difficult to control the movement speed of the intermediate transfer belt with high precision by controlling the rotational speed of the driving roller.

As described above, even when the rotational speed of the driving roller is controlled such that the movement speed of the intermediate transfer belt becomes constant, due to the impact of the variations in the surface speed of the secondary transfer roller, the movement speed of the intermediate transfer belt cannot be controlled with high precision.

In the image forming apparatus described in Patent Document 1, when the current value of the driving motor detected by a current value detecting unit is lower than a target current value of a predetermined range, in the state where the secondary transfer roller and the intermediate transfer belt are in contact, it is determined that drag turning of the intermediate transfer belt has occurred. In order to resolve the drag turning, control is implemented to decrease the rotational speed of the secondary transfer roller such that the current value is included in the predetermined range of the target current value, and the set speed of the secondary transfer roller is adjusted.

However, the target current value of a predetermined range is set according to design parameters such as the motor specification and the control margin, and the target current value is set to have a wide range in consideration of the individual differences (tolerance), the environment, and time-dependent variations. Therefore, by adjusting the set speed of the secondary transfer roller based on a wide predetermined range, such that the current value of the driving motor detected by the current value detecting unit is lower than the target current value of a predetermined range, the adjustment is insufficient, and the image quality demanded by the market cannot be obtained.

Furthermore, there is known an image forming apparatus of a direct transfer method, in which a toner image on a photoconductive belt that is a belt image bearer, is directly transferred onto a transfer material such as a sheet, at a transfer part formed by causing the photoconductive belt and the transfer roller to contact each other. Also in such an image forming apparatus of a direct transfer method, according to the same reasons as above, it is difficult to control the movement speed of the photoconductive belt with high precision due to the impact of the variations in the surface speed of the transfer roller.

Patent Document 1: Japanese Laid-Open Patent Publication No. 2011-180565

SUMMARY OF THE INVENTION

The present invention provides a transfer device and an image forming apparatus, in which one or more of the above-described disadvantages are eliminated.

According to an aspect of the present invention, there is provided a transfer device including an endless belt image bearer which is rotatably stretched around a plurality of stretching members; a driving roller configured to drivingly rotate the belt image bearer, the driving roller being one of the plurality of stretching members; a first driving motor configured to drivingly rotate the driving roller; a first speed detecting unit configured to detect a rotational speed of the belt image bearer; a rotatable transfer member configured to abut an outer peripheral surface of the belt image bearer and form a transfer nip, wherein an image borne on the outer peripheral surface of the belt image bearer is transferred onto a transfer material that is sandwiched in the transfer nip; a second driving motor configured to drivingly rotate the transfer member; a second speed detecting unit configured to detect a rotational speed of the transfer member; a contact separation unit configured to cause the belt image bearer and the transfer member to contact and separate from each other; a relative speed setting unit configured to obtain and set a relative speed of the belt image bearer and the transfer member, such that a variation amount is less than a predetermined variation amount, the variation amount being an amount of variation of a value relating to a driving torque of the first driving motor and a value relating to a driving torque of the second driving motor in a second state in which the belt image bearer and the transfer member are caused to contact each other by the contact separation unit, with respect to a value relating to the driving torque of the first driving motor and a value relating to the driving torque of the second driving motor in a first state in which the belt image bearer and the transfer member are caused to separate from each other by the contact separation unit; and a control unit configured to control at least one of the first driving motor and the second driving motor such that the belt image bearer and the transfer member are rotated at rotational speeds corresponding to the relative speed set by the relative speed setting unit.

According to an aspect of the present invention, there is provided an image forming apparatus including a toner image forming unit configured to form a toner image; a belt image bearer configured to bear the toner image formed by the toner image forming unit; and a transfer unit configured to transfer the toner image from the belt image bearer to a transfer material, wherein the transfer device described above is used as the transfer unit.

According to an aspect of the present invention, there is provided a non-transitory computer-readable recording medium storing a program that causes a computer that constitutes a transfer device to execute a process, the transfer device being controlled to transfer an image, which is borne on a peripheral surface of a belt image bearer rotatably stretched around a plurality of stretching members including a driving roller, onto a transfer material sandwiched in a transfer nip formed by causing the belt image bearer and a transfer member to abut each other, the process including obtaining and setting, by a relative speed setting unit, a relative speed of the belt image bearer and the transfer member, such that a variation amount is less than a predetermined variation amount, the variation amount being an amount of variation of a value relating to a driving torque of a first driving motor, which drivingly rotates the driving roller, and a value relating to a driving torque of a second driving motor, which drivingly rotates the transfer member, in a second state in which the belt image bearer and the transfer member are caused to contact each other by a contact separation unit, with respect to a value relating to the driving torque of the first driving motor and a value relating to the driving torque of the second driving motor in a first state in which the belt image bearer and the transfer member are caused to separate from each other by the contact separation unit, and controlling, by a control unit, at least one of the first driving motor and the second driving motor such that the belt image bearer and the transfer member are rotated at rotational speeds corresponding to the relative speed set by the relative speed setting unit.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

First Embodiment

A description is given of a first embodiment applied to a color printer of an electrophotographic method (hereinafter, simply referred to as a "printer") that is an image forming apparatus for which the present invention will be implemented. Note that the printer according to the present embodiment is a so-called tandem-type image forming apparatus, adopting a dry two-component developing method using a dry two-component developer; however, the present invention is not so limited.

Figure 2:
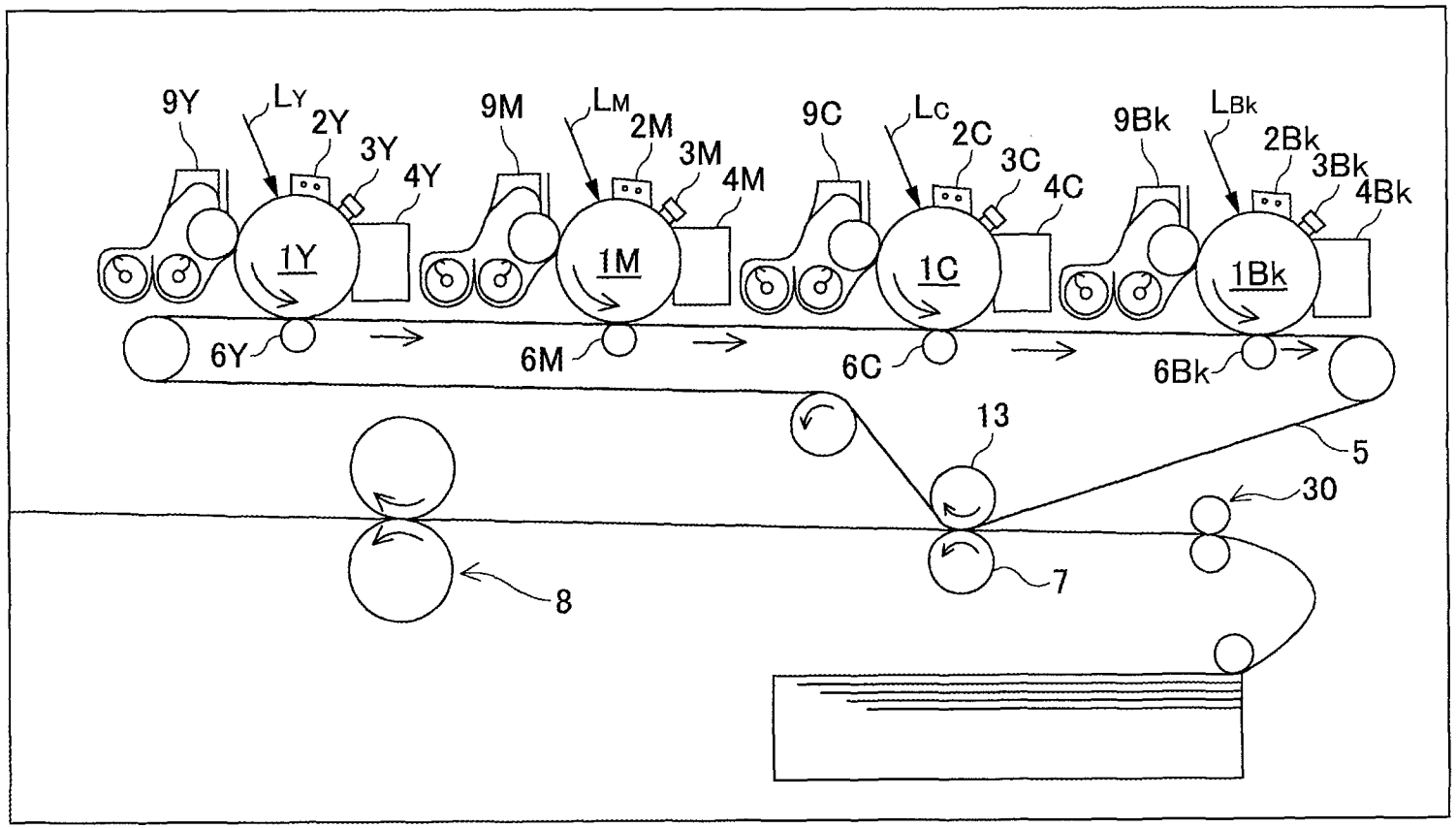
FIG. 2 is a schematic configuration diagram of the entire image forming unit in an example of a printer.

FIG. 2 is a schematic configuration diagram of the entire image forming unit in an example of a printer. This printer performs an image forming process upon receiving image data that is image information, from an image reading unit.

As illustrated in FIG. 2, in this printer, photoconductive drums 1Y, 1M, 1C, 1Bk, as latent image bearers which are four rotating bodies for the respective colors of yellow (Y), magenta (M), cyan (C), black (Bk), are arranged in juxtaposition with each other.

Figure 3:
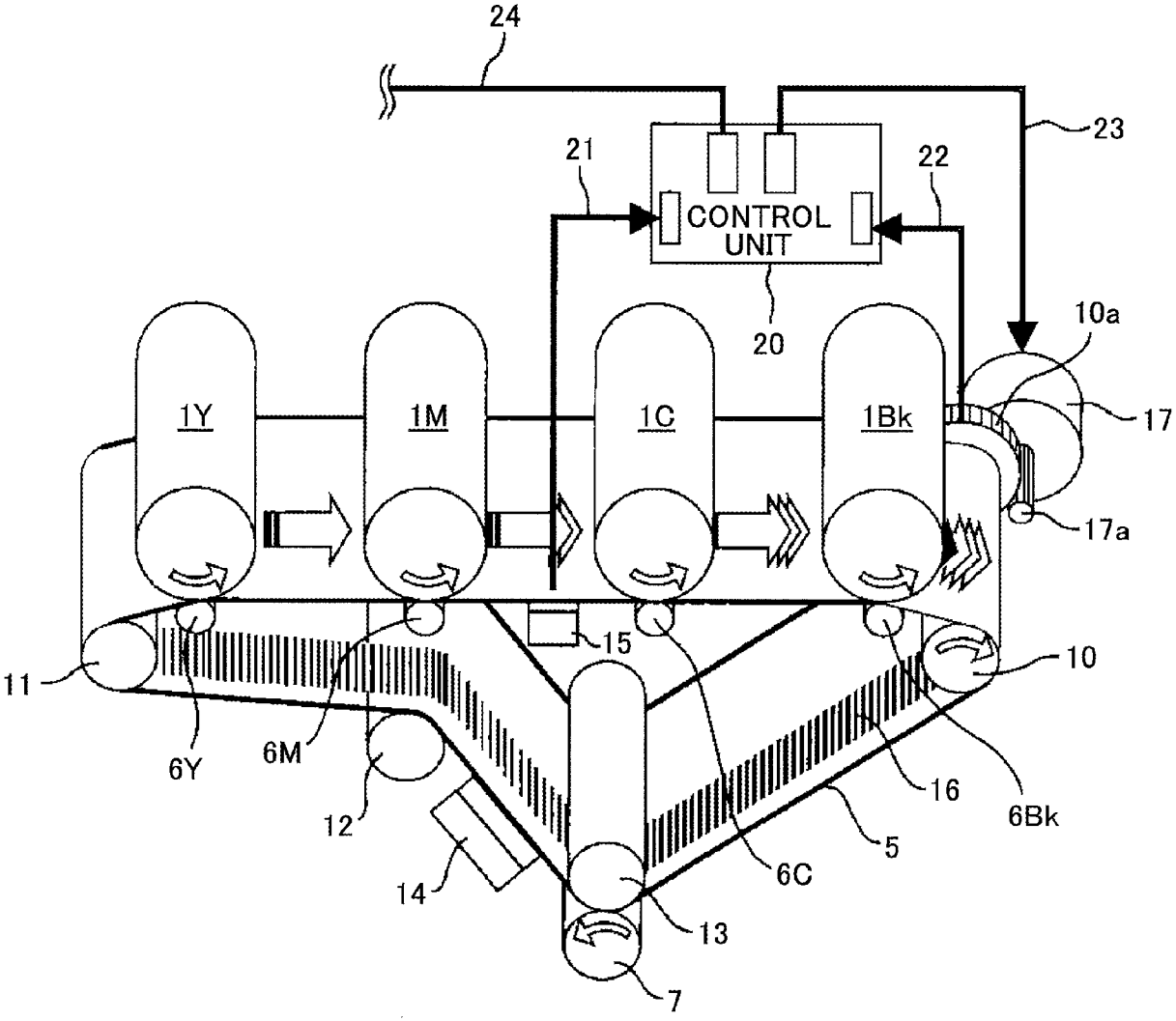
FIG. 3 is a perspective view of an intermediate transfer belt driving device and a motor control unit.

The photoconductive drums 1Y, 1M, 1C, 1Bk are arranged side-by-side along a belt movement direction of an intermediate transfer belt 5, so as to be in contact with the intermediate transfer belt 5, which is an endless belt supported by a plurality of rotatable rollers including a driving roller 10 (see FIG. 3). Furthermore, chargers 2Y, 2M, 2C, 2Bk, developing devices 9Y, 9M, 9C, 9Bk, cleaning devices 4Y, 4M, 4C, 4Bk, and discharging lamps 3Y, 3M, 3C, 3Bk, are respectively arranged around the photoconductive drums 1Y, 1M, 1C, 1Bk in the order of processes.

When forming a full-color image with the printer according to the present embodiment, the photoconductive drum 1Y is uniformly charged by the charger 2Y while being drivingly rotated, and then the photoconductive drum 1Y is irradiated with a light beam LY from an optical writing device, to form a Y electrostatic latent image on the photoconductive drum 1Y. The Y electrostatic latent image is developed with the Y toner in the developer, by the developing device 9Y. At the time of development, a predetermined developing bias is applied between the developing roller and the photoconductive drum 1Y, and the Y toner on the developing roller is electrostatically attracted on the Y electrostatic latent image part of the photoconductive drum 1Y.

The Y toner image developed and formed as above is conveyed, according to the rotation of the photoconductive drum 1Y, to the primary transfer position where the photoconductive drum 1Y and the intermediate transfer belt 5 contact each other. At this primary transfer position, on the back side of the intermediate transfer belt 5, a predetermined bias voltage is applied by a primary transfer roller 6Y. Then, by a primary transfer electric field generated by this bias application, the Y toner image on the photoconductive drum 1Y is drawn toward the intermediate transfer belt 5, and is transferred onto the intermediate transfer belt 5 by primary transfer. Similarly, an M toner image, a C toner image, and a Bk toner image are also sequentially transferred by primary transfer to be superimposed on the Y toner image on the intermediate transfer belt 5.

Then, the toner image in which four colors are superimposed on each other on the intermediate transfer belt 5, is conveyed to a secondary transfer position facing a secondary transfer roller 7, according to the rotation of the intermediate transfer belt 5. Furthermore, to this secondary transfer position, a sheet that is a transfer material is conveyed, at a predetermined timing by a pair of registration rollers 30. Then, at this secondary transfer position, a predetermined bias voltage is applied to the back side of the sheet by the secondary transfer roller 7, and due to the secondary transfer electric field generated by the bias application and the contact pressure at the secondary transfer position, the superimposed toner images on the intermediate transfer belt 5 are transferred at once on the sheet by secondary transfer. Subsequently, the sheet, on which the toner image has been transferred by secondary transfer, is subjected to a fixing process by a pair of fixing rollers 8, and is ejected outside the apparatus.

FIG. 3 is a perspective view of an intermediate transfer belt driving device and a motor control unit 20. The intermediate transfer belt 5 is stretched around a plurality of stretching rollers arranged inside the belt loop, and is endlessly moved by the driving rotation of the driving roller 10, which is one of the stretching rollers. This driving roller 10 is connected to an intermediate transfer driving motor 17, which is a driving source, via a decelerating mechanism. The decelerating mechanism includes a small diameter gear 17*a* at the rotating shaft of the intermediate transfer driving motor 17, and a large diameter gear 10*a* at the rotating shaft of the driving roller 10, which are meshed together.

As a conveying speed detector of the intermediate transfer belt 5, there is a detector of a belt encoder method. On the front side or the back side of the intermediate transfer belt 5, encoder patterns 16 are inscribed. By reading these encoder patterns 16 with a belt encoder sensor 15, the belt surface speed is detected.

In FIG. 3, the belt encoder sensor 15 is disposed in the mid-way between a driven roller 11 and the driving roller 10; however, in order to correctly measure the belt surface speed, the belt encoder sensor 15 may be located anywhere else as long as the location is flat.

For example, if the belt encoder sensor 15 is laid out on a rotating shaft that is not flat, the curvature of the shaft affects the detection results, and the detected intervals between the encoder patterns 16 change due to the variation in the thickness of the intermediate transfer belt 5 caused by manufacturing defects and variations in the environment. Thus, the belt surface speed cannot be correctly measured, and therefore it is necessary to avoid locating the belt encoder sensor 15 on a rotating shaft that is not flat.

The encoder patterns 16 may be manufactured by any method, such as attaching sheet type encoder patterns, directly performing pattern processing on the belt, or processing the patterns at the same time as the manufacturing process of the intermediate transfer belt 5.

Here, the belt encoder sensor 15 is assumed to be a reflective optical sensor including equally spaced slits; however, the belt encoder sensor 15 may be any sensor as long as the belt encoder sensor 15 can accurately detect the belt surface position from the encoder patterns 16. For example, a CCD camera, etc., may be used to detect the surface position by image processing.

Furthermore, the encoder patterns 16 may be eliminated, in the case of a Doppler method or a sensor method of detecting the surface position by image processing based on the asperity of the belt surface.

Another example of a conveying speed detector of the intermediate transfer belt 5 is a rotary encoder method. Specifically, a rotation detector is provided on the rotating shaft of the driven roller 11, which is one of the plurality of stretching rollers. The driven roller 11 is a roller that rotates by being driven according to the endless movement of the intermediate transfer belt 5, and can detect the conveying speed of the intermediate transfer belt 5.

In the entire area of the intermediate transfer belt 5 in the circumferential direction, an area past the position wound around the driven roller 11 and before entering the position wound around the driving roller 10, is the area that comes in contact with the photoconductors for M, C, Y, K to form primary transfer nips for M, C, Y, K. Transfer rollers abut the positions for forming the primary transfer nips for M, C, Y, K on the intermediate transfer belt 5, from the back side of the belt. As a transfer bias is applied to these transfer rollers from a power source, transfer electric fields are formed between the belt and the photoconductors at the primary transfer nips of the respective colors.

A color image is formed at the primary transfer part, and therefore the belt conveying speed is preferably detected and controlled at this part. Thus, it is preferable to dispose a rotary encoder on the driven roller 11, or to dispose the belt encoder sensor 15 between the driven roller 11 and the driving roller 10.

Furthermore, a stretching roller denoted by a reference numeral 12 in the figure, is a tension roller. The tension roller 12 is pressed against the belt from the outside of the belt loop, and generates a fixed belt tension.

According to the belt tension generated by the tension roller 12, the intermediate transfer belt 5 abuts the surfaces of the respective stretching rollers, and the intermediate transfer belt 5 is conveyed in the circumferential direction. Particularly, the abutment force between the surface of the driving roller 10 and the intermediate transfer belt 5 has a correlation with the belt conveying frictional force of the driving roller 10, and is thus important. Therefore, the pressing force of the tension roller 12 is set such that the conveying frictional force necessary for conveying the intermediate transfer belt 5 can be secured.

Furthermore, a stretching roller denoted by a reference numeral 13 in the figure, is a secondary transfer counter roller. Note that on the outside of the belt loop, the secondary transfer roller 7 is disposed at the position facing the secondary transfer counter roller 13, and the secondary transfer roller 7 abuts the front side of the intermediate transfer belt 5. By applying electrical charges on the secondary transfer roller 7 and the front side of the intermediate transfer belt 5, the sheet is attracted onto the front side of the intermediate transfer belt 5.

Furthermore, on the outside of the belt loop, a belt cleaning device 14, which is disposed on the downstream side of the secondary transfer roller 7 in the belt conveying direction, abuts the belt 5. The belt cleaning device 14 collects foreign objects such as toner, which are adhering on the front side of the belt, from the front side of the belt by the potential difference between the toner and the belt cleaning device 14 itself.

In order to fix the conveying speed of the intermediate transfer belt 5, the motor control unit 20 implements feedback control on the intermediate transfer driving motor 17. The motor control unit 20 outputs intermediate transfer driving motor drive control signals 23, based on sensor output 21, which is the conveying speed information of the intermediate transfer belt 5, and sensor output 22, which is the rotation information of the driving roller 10.

Figure 4:
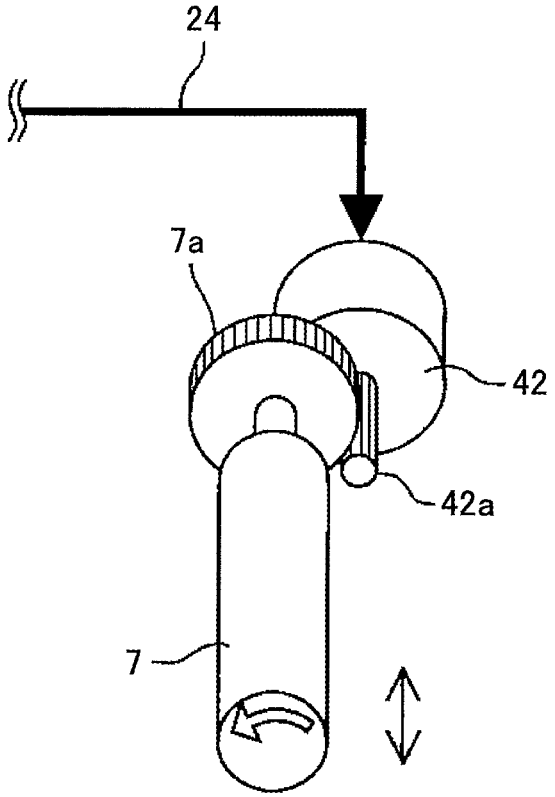
FIG. 4 illustrates a driving mechanism of a secondary transfer roller.

Furthermore, at the same time, in order to suppress variations in the conveying speed of the intermediate transfer belt 5, which is caused by the abutment of the secondary transfer roller 7 and a sheet passing through the secondary transfer part, the motor control unit 20 implements feedback control on a secondary transfer driving motor 42 (see FIG. 4). The motor control unit 20 outputs secondary transfer driving motor control signals 24 of the secondary transfer driving motor 42, based on sensor output 21, which is the conveying speed information of the intermediate transfer belt 5, and sensor output 22, which is the rotation information of the driving roller 10.

Next, a description is given of a driving mechanism of the secondary transfer roller 7. FIG. 4 illustrates a driving mechanism of the secondary transfer roller 7 adopted in the image forming apparatus according to the present embodiment.

Apart from the intermediate transfer driving motor 17 for drivingly rotating the driving roller 10, there is provided the secondary transfer driving motor 42 for drivingly rotating the secondary transfer roller 7. By the secondary transfer driving motor control signals 24 sent from the motor control unit 20 (see FIG. 5), the rotation is controlled to rotate or stop the secondary transfer driving motor 42. As the secondary transfer driving motor 42, similar to the intermediate transfer driving motor 17, a DC motor with a brush or a brushless DC motor may be used.

The rotational speed of the secondary transfer driving motor 42 is decelerated by a decelerating mechanism including a small diameter gear 42*a* at the rotating shaft of the secondary transfer driving motor 42, and a large diameter gear 7*a* at the rotating shaft of the secondary transfer roller 7. As the secondary transfer roller 7, which is connected to the decelerating mechanism, rotates in the counterclockwise direction as viewed in the figure, the sheet that is conveyed to the secondary transfer part is conveyed.

Opposite to the secondary transfer roller 7, there is provided the secondary transfer counter roller 13 that supports the intermediate transfer belt 5. The secondary transfer roller 7 abuts the secondary transfer counter roller 13 across the intermediate transfer belt 5. The abutment of the secondary transfer roller 7 is caused by a spring. Furthermore, by a cam mechanism, the secondary transfer roller 7 can separate from the intermediate transfer belt 5, against the biasing force of the spring.

As the secondary transfer roller 7 is moved in the direction of the arrow in the figure by a contact/separation unit including the spring and the cam mechanism, state of the secondary transfer roller 7 with respect to the intermediate transfer belt 5 (secondary transfer counter roller 13) at the secondary transfer part, is switched between an abutment state and a separated state. Furthermore, by separating the secondary transfer roller 7 from the intermediate transfer belt 5, it is possible to retrieve a belt mechanism and to perform maintenance when a paper conveying jam occurs.

In order to improve the transfer properties of the secondary transfer part, an elastic layer is provided on the surface of the secondary transfer roller 7. Accordingly, the transfer roller 7 abuts the intermediate transfer belt 5 such that the nip area is increased, and to follow the surface roughness of the sheet. In an example of the secondary transfer roller 7, a low inertia thin metallic pipe is at the center, a low hardness rubber material roller part (elastic rubber layer) made of silicon rubber, etc., is provided around the pipe, and an urethane coating layer is applied on the surface layer.

In a secondary transfer roller 7 applied to image forming apparatuses in recent years, a conductive rubber roller part includes a lower layer made of vulcanized rubber or silicon based rubber having a rubber hardness of less than or equal to 40 [°] (rubber hardness A scale), and the surface layer has a thin layer that is an urethane coating layer that invalidates the viscosity. Accordingly, due to the abutment deformation of the conductive rubber roller part, the nip area is increased, and appropriate pressure necessary for transfer can be secured.

Generally, in order to realize a low hardness of less than or equal to 40 [°] by a method other than a foamed rubber structure, the viscosity increases by adding a plasticizer in the case of vulcanized rubber. Furthermore, the viscosity increases also in the case of silicon rubber. As a result, a movement failure occurs between the two moving bodies, due to the adhesion at the transfer belt contact part or the adhesion with the sheet contact part. In order to avoid such a failure, it is effective to have the urethane coating layer applied on the surface layer as described above.

In the drive control method in a conventional secondary transfer driving motor, the rotation of the motor itself is driven at a constant speed by using a stepping motor having excellent constant speed properties, or the rotation of the motor shaft is detected by FG signals and the motor shaft rotational speed is driven at a constant speed by using a brushless DC motor.

The intermediate transfer driving motor 17 drivingly controls the intermediate transfer belt 5 to be conveyed by a predetermined speed, by implementing the above-described intermediate transfer belt drive control. Meanwhile, the secondary transfer driving motor 42 drives the motor shaft or the secondary transfer roller shaft at a constant speed. At this time, when the deformation amount of the secondary transfer roller 7 changes from the initial design value, the secondary transfer roller surface speed becomes different from the intermediate transfer belt conveying speed, which affects the conveyance of the secondary transfer belt.

In recent years, in order to improve the transfer properties when transferring an image from the intermediate transfer belt 5 to a sheet at the secondary transfer part, as the secondary transfer roller 7, a roller member that is easily deformable having a rubber hardness of approximately 40 [°] and that has a low surface hardness has been used. Accordingly, the variation amount of the roller shape is large, due to the tolerance of the secondary transfer roller diameter, variations in the contact pressure, the environment, and time-dependent variations. This causes a serious deviation (variation) in the surface speed of the secondary transfer roller 7. Accordingly, the difference between the secondary transfer roller surface speed and the intermediate transfer belt conveying speed is likely to vary. Furthermore, a urethane coating is applied on the surface layer of the secondary transfer roller 7; however, the frictional force between the secondary transfer roller 7 and the transfer belt 5 increases due to the increase of the nip area, and the above speed difference has a large impact on the intermediate transfer belt 5.

In recent years, there is increased demand for handling various kinds of sheets, and the range of thicknesses of conveyed sheets is increasing. Due to the thickness of the sheet, the deformation amount of the secondary transfer roller 7 also changes, and the variation in the speed difference further increases. Furthermore, by conveying sheets of different types, particularly surface-coated paper and Japanese paper having rough paper fiber on the surface, the frictional force between the secondary transfer roller 7 and the transfer belt varies significantly, and the impact of the speed difference on the intermediate transfer belt 5 further increases.

The surface speed of the secondary transfer roller 7 with respect to the surface speed of the intermediate transfer belt 5 does not only affect the intermediate transfer belt drive control performance, but also significantly affects the transfer image. When the surface speed of the secondary transfer roller 7 is higher than the surface speed of the intermediate transfer belt 5, the image that is transferred from the intermediate transfer belt 5 to the sheet is extended and the image length becomes long. Conversely, when the surface speed of the secondary transfer roller 7 is lower than the surface speed of the intermediate transfer belt 5, the image that is transferred from the intermediate transfer belt 5 to the sheet is reduced and the image length becomes short.

For example, when an image having a length of 400 [mm] is transferred onto an A3 size sheet, if the surface speed of the secondary transfer roller 7 is higher than the surface speed of the intermediate transfer belt 5 by 0.1 [%], the image transferred from the intermediate transfer belt 5 to the sheet becomes longer by 0.4 [mm]. Such a change in the image length becomes a significant problem in the case of printed matter that requires precision in the positions of transfer images on the front and back sides of a sheet, and in the case of printed matter in which an image frame is already set.

Figure 5:
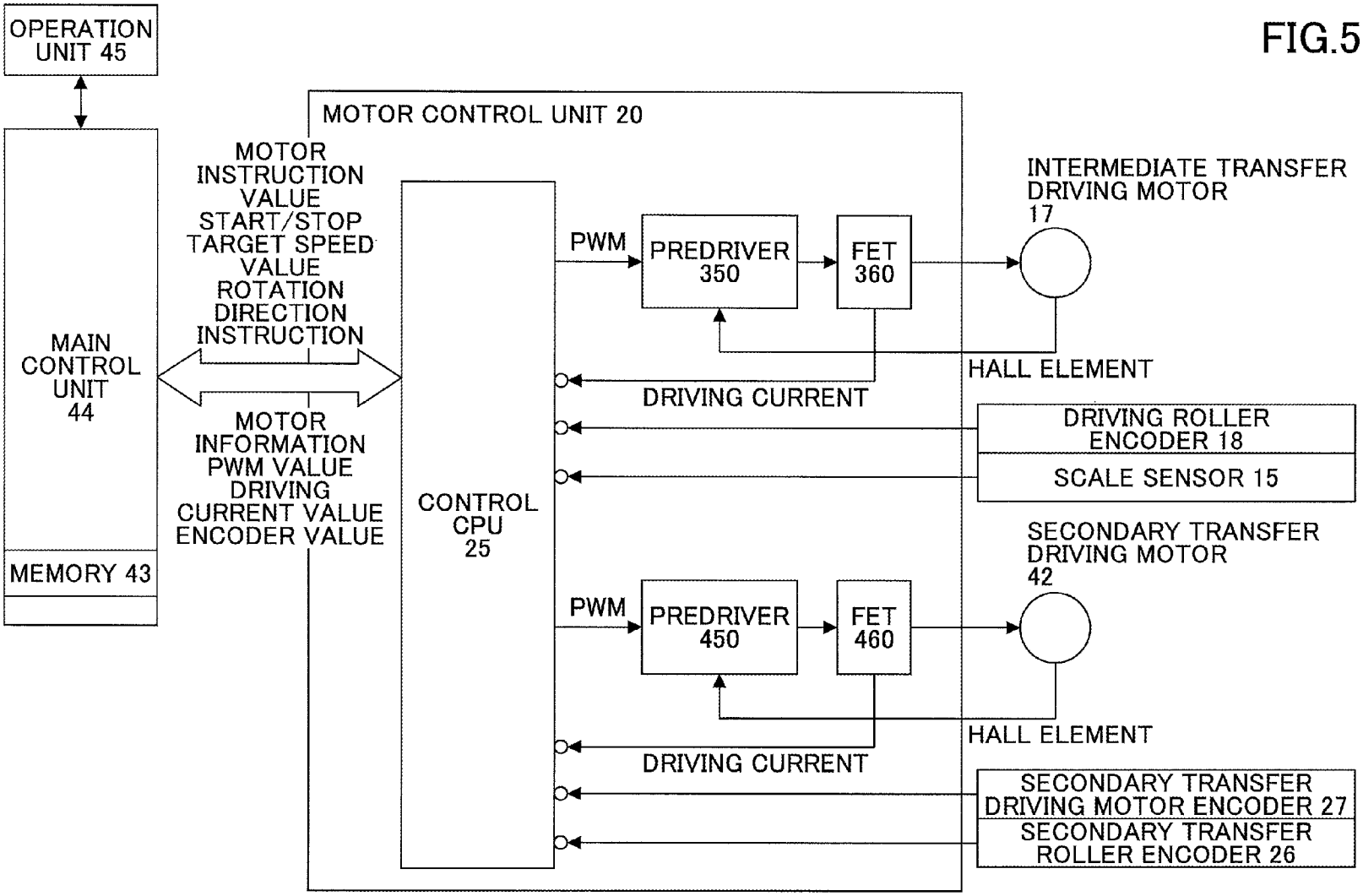
FIG. 5 is a block diagram of elements centering around an intermediate transfer driving motor of an intermediate transfer device and a motor control unit of a secondary transfer driving motor.

FIG. 5 is a block diagram of elements centering around the intermediate transfer driving motor 17 of the intermediate transfer device and the motor control unit 20 of the secondary transfer driving motor 42 according to the present embodiment.

In FIG. 5, the motor control unit 20 has a built-in control CPU 25. The motor control unit 20 receives a motor instruction value from a main control unit 44 (includes a memory 43 that is the storage unit and a setting unit in a rotation body abutment device) that controls the entire image forming apparatus, controls the rotational speed of the intermediate transfer driving motor 17 (corresponding to a first control unit in the rotation body abutment device), and controls the rotational speed of the secondary transfer driving motor 42 (corresponding to a second control unit in the rotation body abutment device).

Furthermore, in the motor control unit 20, the control CPU 25 collects various kinds of information described below, calculates the control output to the respective motors, and outputs the calculated output as PWM (pulse-width modulation signals). The following are examples of various kinds of information. There are the rotational speed information from the belt encoder sensor 15, a secondary transfer roller encoder 26, and a secondary transfer driving motor encoder 27; and a driving current value from the intermediate transfer driving motor 17 and the secondary transfer driving motor 42.

Predrivers 350, 450 recognize the rotation angle of the motors by Hall element signals, convert the PWM signals into motor three-phase output signals, and drive the motors via FET 360, 460. Accordingly, the rotational speeds of the intermediate transfer driving motor 17 and the secondary transfer driving motor 42 are controlled to become target speeds, based on target speed signals which are instruction values of the motors.

The driving current of the motor can be calculated for PWM signals; however, errors may occur due to the impact of variations and the responsiveness of the motor driving circuit including the predriver. Therefore, in order to recognize the driving current of the motor with higher precision, the driving current may be recognized by measuring the current of an FET.

Furthermore, according to need, the control CPU 25 stores the collected data and calculated data in the memory 43 (corresponding to a storage unit in the rotation body abutment device) and reports information such as an abnormality report of the intermediate transfer device to the main control unit 44.

The main control unit 44 acquires abutment operation information of the secondary transfer roller 7 according to another motor. Furthermore, the main control unit 44 is connected to an operation unit 45, and an operator can implement control by giving instructions from the operation unit 45 to the motor control unit 20 via the main control unit 44.

Figure 6A:
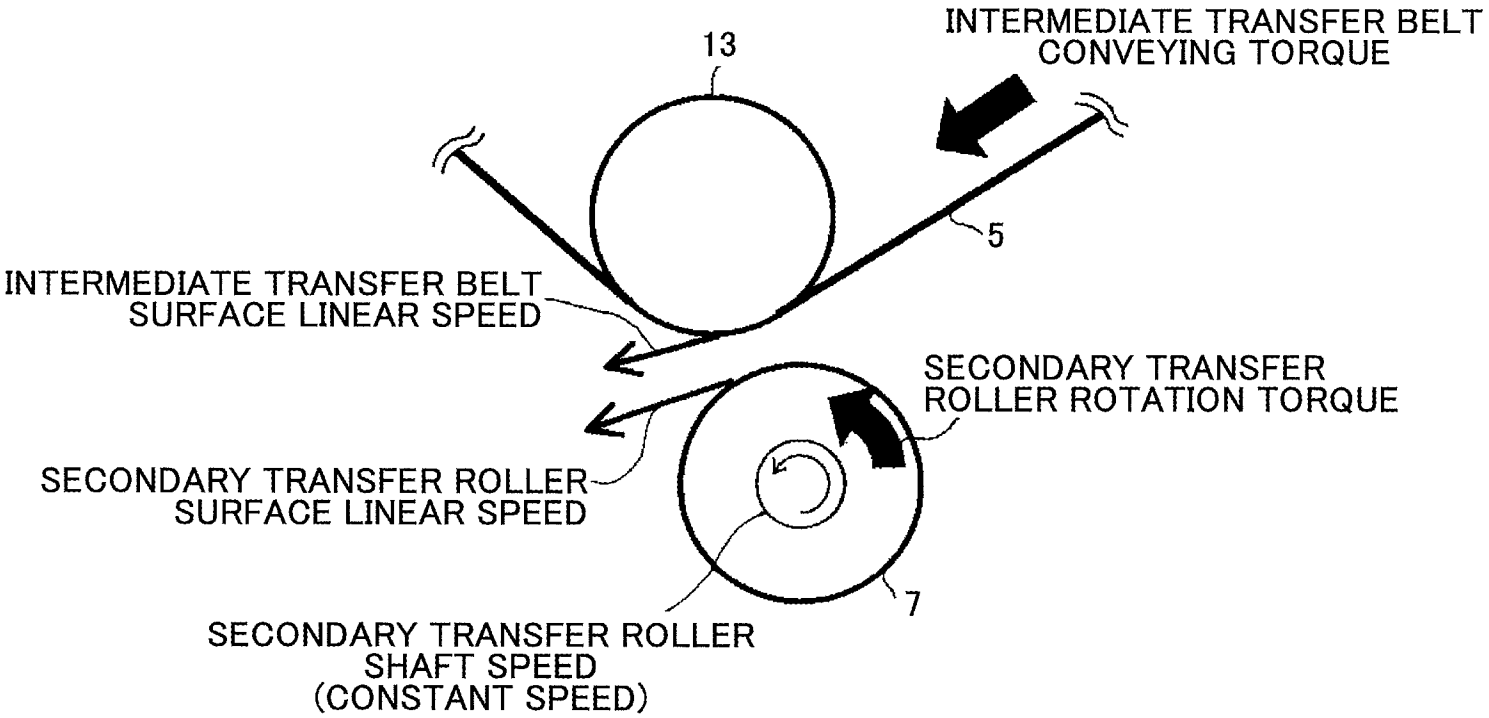
FIG. 6A illustrates a case where an intermediate transfer belt and a secondary transfer roller are in a separated state and are respectively driven at a constant speed.
Figure 6B:
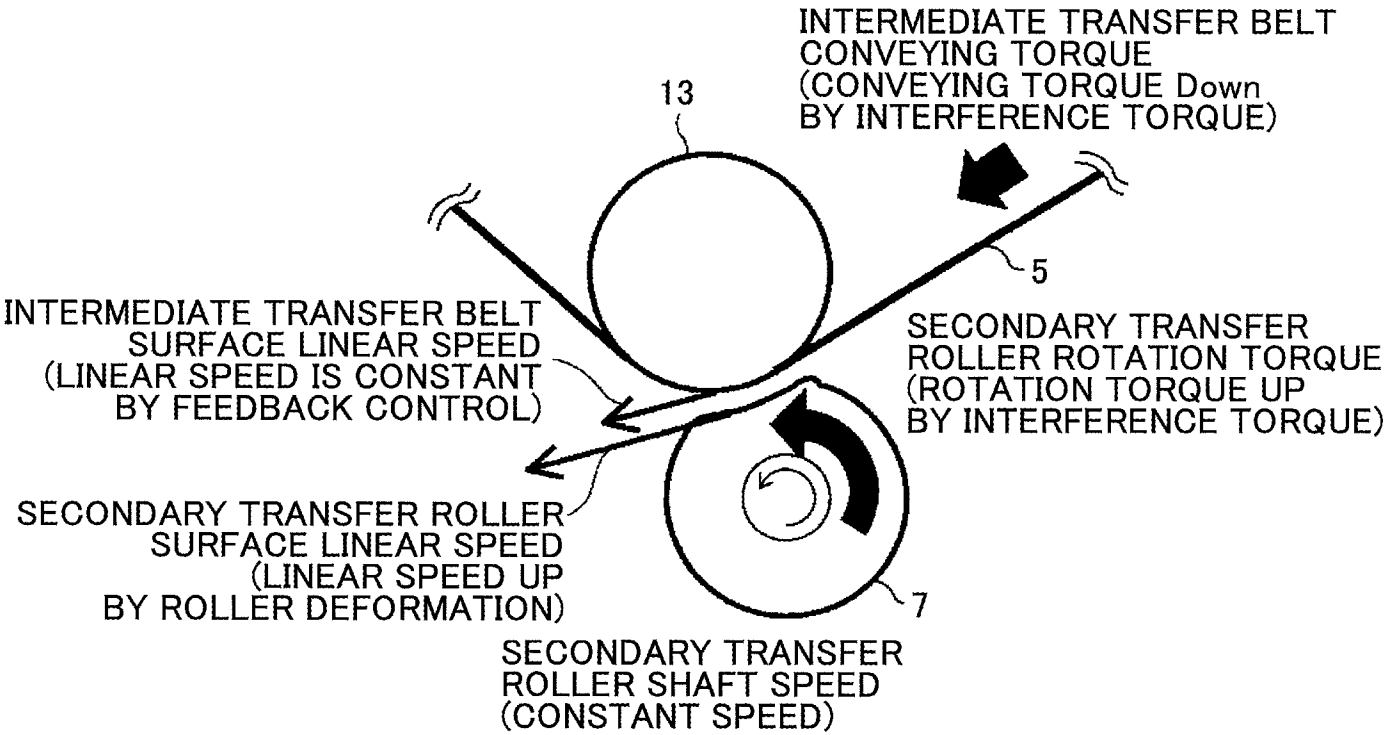
FIG. 6B illustrates a case where an intermediate transfer belt and a secondary transfer roller are in an abutment state and are respectively driven at a constant speed.

FIGS. 6A and 6B are for describing the impact on the intermediate transfer belt conveying torque caused by the surface speed difference when the secondary transfer roller 7 abuts the intermediate transfer belt 5 and the secondary transfer counter roller 13. Specifically, FIG. 6A illustrates a case where the intermediate transfer belt 5 and the secondary transfer roller 7 are in a separated state and are respectively driven at constant speeds. FIG. 6B illustrates a case where the intermediate transfer belt 5 and the secondary transfer roller 7 are in an abutment state and are respectively driven at a constant speed.

The intermediate transfer belt 5 is drivingly conveyed by implementing feedback control on the rotational speed of the intermediate transfer driving motor 17 such that the rotational speed becomes constant at a target value, based on speed information from the belt encoder sensor 15, and therefore the surface speed of the intermediate transfer belt 5 is always constant. Meanwhile, the secondary transfer roller 7 is subjected to feedback control based on the speed information of the secondary transfer driving motor encoder 27 and the secondary transfer roller encoder 26, and therefore the speed of the rotating shaft of the secondary transfer roller 7 is always constant.

However, the surface speed of the secondary transfer roller 7 does not match that of the intermediate transfer belt 5 due to the roller diameter tolerance. Furthermore, at the time of abutment, the surface linear speed changes significantly according to the deformation amount, and therefore a linear velocity difference arises between the surface speed of the secondary transfer roller 7 and the surface speed of the intermediate transfer belt 5.

For example, as in the case of FIG. 6A where the secondary transfer roller 7 is separated, and the secondary transfer roller 7 and the intermediate transfer belt 5 are drivingly controlled at a defined speed, a torque that is driven monolithically arises in each of these elements. The intermediate transfer belt conveying torque changes according to individual differences, the environment, and time-dependent variations, caused by the conveying roller shaft friction, the surface speed difference and contact friction with respect to the photoconductive drum 1, the contact state of the transfer belt cleaning unit, etc.; however, the intermediate transfer belt conveying torque is a monolithic driving torque at the present time point. Furthermore, the secondary transfer roller rotation torque changes due to the secondary transfer roller shaft friction; however, the secondary transfer roller rotation torque is a monolithic driving torque at the present time point.

Here, as in the case of FIG. 6B where the secondary transfer roller 7 abuts the intermediate transfer belt 5 and the secondary transfer roller 7 significantly deforms, if the rotational speed of the secondary transfer roller shaft is constant, the surface linear speed of the secondary transfer roller 7 increases. Furthermore, when a difference arises in the surface linear speed with respect to the intermediate transfer belt 5 including the tolerance in the roller diameter and the hardness, the intermediate transfer belt 5 and the secondary transfer roller 7 are respectively subjected to feedback control while maintaining constant speeds, and therefore an interference torque arises.

An interference torque is a torque component imposed on the secondary transfer driving motor 42 for bearing the conveying torque of not only the secondary transfer roller 7 but also the intermediate transfer belt 5. Alternatively, the interference torque is a torque component imposed on the intermediate transfer driving motor 17 for bearing the rotation torque of not only the intermediate transfer belt 5 but also the secondary transfer roller 7. In FIG. 6B, the secondary transfer roller 7 attempts to maintain a surface liner speed that is higher than that of the intermediate transfer belt 5, and the intermediate transfer belt 5 attempts to maintain a surface liner speed that is lower than that of the secondary transfer roller 7. Therefore, at the secondary transfer roller 7, the motor torque is increased by the interference torque, and at the intermediate transfer belt 5, the motor torque is decreased by the interference torque.

In recent years, in order to respond to demand for higher image quality, image forming apparatuses have been required to have higher control performance. Thus, it has been needed to adjust the speed of the secondary transfer roller 7 so as not to affect the conveying torque of the intermediate transfer belt 5. For example, when an interference torque is generated, and the interference torque changes in the rotation period of the secondary transfer roller, variations occur in the speed of the intermediate transfer belt 5.

Thus, in accordance with the abutment state of the secondary transfer roller 7 and the intermediate transfer belt 5 as illustrated in FIG. 6B, it is necessary to adjust the rotational speed of the secondary transfer roller 7. The relationship between the set speed and the surface linear speed of the secondary transfer roller 7 differs significantly depending on the environment (temperature and humidity) and the tolerance (roller hardness), and therefore it is difficult to recognize this relationship beforehand.

Furthermore, the generation of the interference torque is largely affected by the surface linear speed difference between the secondary transfer roller 7 and the intermediate transfer belt 5, and the friction coefficient of the secondary transfer part (between the secondary transfer roller 7 and the intermediate transfer belt 5, between the sheet and the intermediate transfer belt 5, and between the sheet and the secondary transfer roller 7).

Even when the surface linear speed difference is large, if the friction coefficient is zero, the interference torque will be zero. Meanwhile, even when the surface linear speed difference is small, if the friction coefficient is high, the interference torque will be large. Therefore, the interference torque varies largely depending on each image forming apparatus and the type of paper of the sheet, and it is difficult to recognize the interference torque beforehand.

Due to the above problems, the image forming apparatus according to the present embodiment recognizes the interference torque characteristics when the secondary transfer roller 7 and the intermediate transfer belt 5 are in an abutment state, derives an optimum speed setting according to the abutment state of the secondary transfer roller 7, and uses the derived speed setting.

Figure 7:
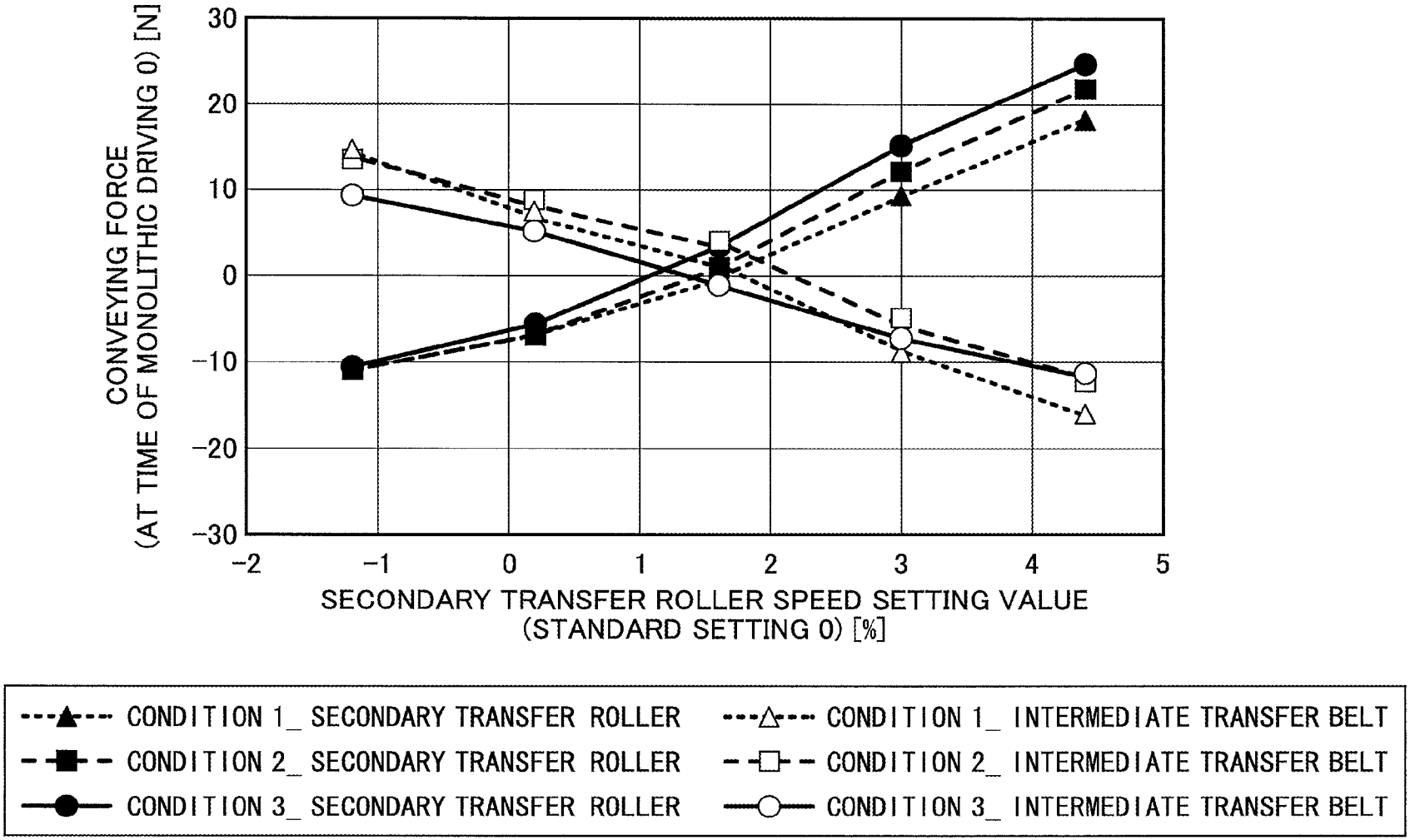
FIG. 7 illustrates the relationship between the abutment state of the secondary transfer roller and the interference torque.

FIG. 7 illustrates the relationship between the abutment state of the secondary transfer roller 7 and the interference torque. The horizontal axis of FIG. 7 indicates the speed setting value of the secondary transfer roller 7, which is indicated by a percentage assuming that the standard setting value is "0". Note that the standard setting value is a value at which the roller surface speed of the secondary transfer roller 7 in an abutment state is assumed to match the surface speed of the intermediate transfer belt 5 based on the design value. In reality, the surface speed does not become the same as the standard setting value, due to the roller tolerance, variations in the contact pressure, the environment, and time-dependent variations.

The vertical axis in FIG. 7 indicates the conveying force on the respective surfaces of the secondary transfer roller 7 and the intermediate transfer belt 5. The conveying force is a value obtained by converting the driving torque [Nm] of the secondary transfer roller 7 and the intermediate transfer belt 5, into the conveying force [N] on the surface based on design values such as the roller diameter. The respective torques of the secondary transfer roller 7 and the intermediate transfer belt 5 are converted as a matter of convenience, in order to express these values on the same axis in the graph.

The driving torque of the intermediate transfer belt 5 is obtained by converting the torque estimation value of the intermediate transfer driving motor 17 into a conveying force of the surface of the intermediate transfer belt 5, in consideration of the deceleration ratio, the driving roller diameter, and the thickness of the intermediate transfer belt 5. Furthermore, the driving torque of the secondary transfer roller 7 is obtained by converting the torque estimation value of the secondary transfer driving motor 42 into the conveying force on the surface of the secondary transfer roller 7, in consideration of the deceleration ratio the driving roller diameter, etc.

Note that the torque estimation value is a load torque value calculated by the main control unit 44, based on current values of the respective driving motors or drive instruction values such as PWM instruction values to the respective driving motors, and the actual rotational speeds of the intermediate transfer belt 5 and the secondary transfer roller 7. In a state where the respective driving motors are controlled with high precision at a constant speed or a default speed, the load torque value can be calculated from only the current values and the PWM instruction values.

A description is given of the interference torque in FIG. 7. In a state where the secondary transfer roller 7 is separated from the intermediate transfer belt 5, the secondary transfer roller 7 and the intermediate transfer belt 5 are respectively driven according to feedback control at constant speeds. Then, in a state where there is no interference torque at all, the respective torques of the intermediate transfer belt 5 and the secondary transfer roller 7 are set to be the standard "0", as an intermediate transfer monolithic conveying torque and a secondary transfer monolithic driving torque. While the intermediate transfer belt 5 and the secondary transfer roller 7 are respectively subjected to feedback control at constant speeds, the secondary transfer roller 7 abuts the intermediate transfer belt 5. At this time, the surface speed of the secondary transfer roller 7 does not match the surface speed of the intermediate transfer belt 5, due to factors such as tolerance.

For example, when the secondary transfer roller 7 abuts the intermediate transfer belt 5 and the secondary transfer roller 7 is largely deformed, and the surface speed increases, the secondary transfer driving torque increases, and the conveying torque of the intermediate transfer belt 5 decreases. The inverse correlation of the torque transitions of the secondary transfer roller 7 and the intermediate transfer belt 5 corresponds to the interference torque. Furthermore, in FIG. 7, the interference torque is expressed by being converted into a conveying force.

FIG. 7 expresses the transition of the conveying force, obtained from the intermediate transfer belt conveying torque and the secondary transfer driving torque, in a case where the set speed of the secondary transfer roller 7 is changed. The interference torque and the converted conveying force of the secondary transfer roller 7 and those of the intermediate transfer belt 5, are in an inverse correlation.

According to these interference torque characteristics (here, the conveyance force characteristics), the optimum value of the secondary transfer roller speed setting value of the zero cross point, is near 1.5 [%] in the property example of FIG. 7. Under optimum conditions, there is no change in the driving torque between monolithic driving and abutment driving, and stable driving operations can be realized in driving the intermediate transfer belt 5 and conveying the sheet.

FIG. 7 illustrates the results of measuring the interference torque characteristics under three conditions. It can be seen that the optimum value of the zero cross point differs according to the condition, in the same device. Note that the conditions are combinations of the environmental temperature, the in-device temperature, the secondary transfer roller contact pressure, and the conveying speed. In the following, the three conditions (condition 1, condition 2, condition 3) are indicated.

Condition 1: room temperature environment (25 [° C.]), in-device temperature 30 [° C.], secondary transfer roller contact pressure 100 [%], conveying speed 200 [mm/s]

Condition 2: room temperature environment (25 [° C.]), in-device temperature 30 [° C.], secondary transfer roller contact pressure 80 [%], conveying speed 400 [mm/s]

Condition 3: room temperature environment (35 [° C.]), in-device temperature 45 [° C.], secondary transfer roller contact pressure 100 [%], conveying speed 200 [mm/s]

The optimum value differs according to these conditions, and therefore there is a need to measure the interference torque characteristics as needed, and to optimize the speed setting value of the secondary transfer roller 7.

In the present embodiment, the speed setting of the secondary transfer roller 7 is derived from the above interference torque characteristics, by a control unit provided in the image forming apparatus.

Figure 8A:
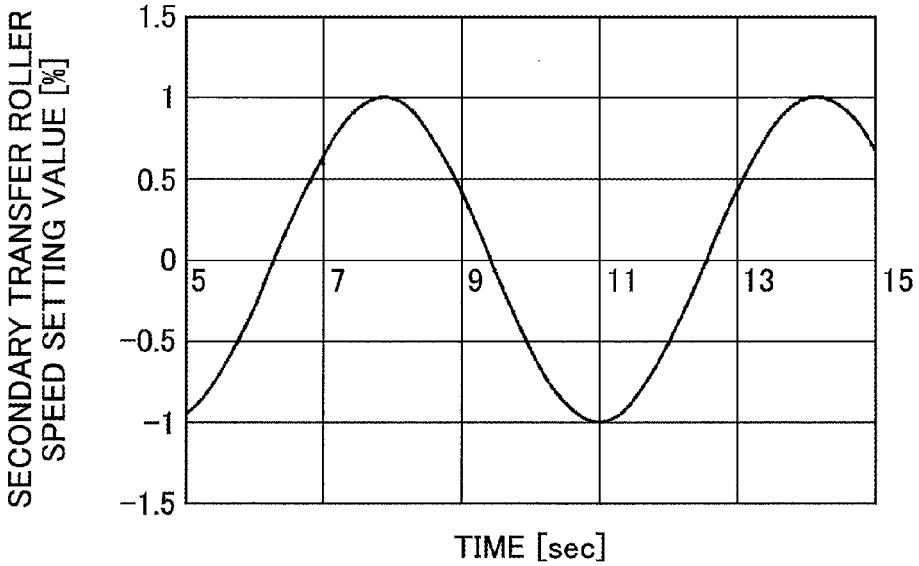
FIGS. 8A and 8B illustrate a process of deriving an optimum value of the speed setting of the secondary transfer roller.
Figure 8B:
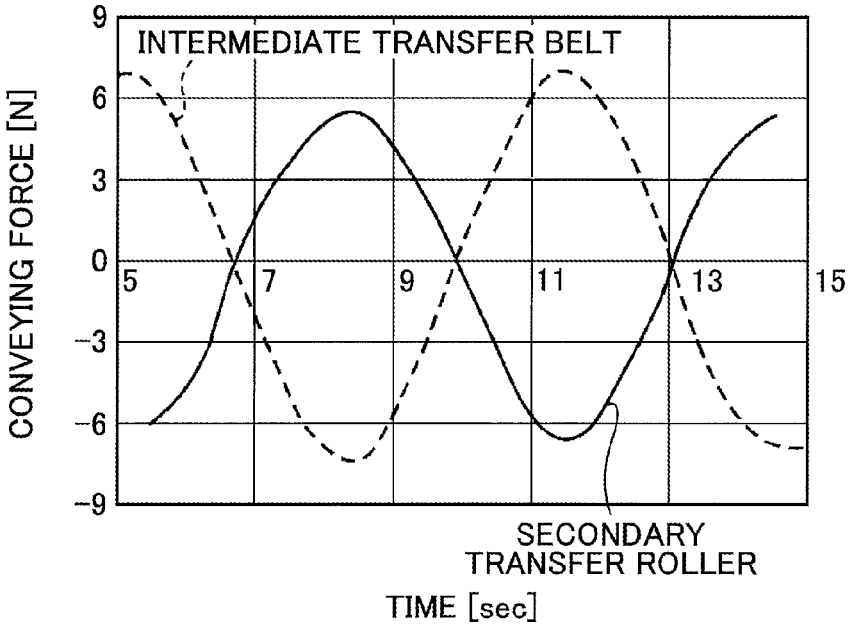

FIGS. 8A and 8B illustrate a process of deriving the optimum value of the speed setting of the secondary transfer roller 7 according to the present embodiment. In the measurement of the interference torque characteristics illustrated in FIG. 7, the torque estimation value, in a state where the intermediate transfer belt 5 and the secondary transfer roller 7 are separated, is used as a standard. Then, the intermediate transfer belt 5 and the secondary transfer roller 7 abut each other, and several levels of the set speeds are set. The amount, by which the torque estimation value changes from the standard value in each level, is plotted as an interference torque, and the characteristics of the interference torque can be measured.

However, the motor torque estimation value in the actual device does not only include the interference torque components, but also many other load torque components. Examples of a load torque component are a contact load of the cleaning blade, a contact load of the photoconductive drum 1, an acceleration and deceleration torque for correcting the variations in the speed of the secondary transfer roller 7 and the intermediate transfer belt 5, etc.

In order to remove such noise components and determine the interference torque component, a filter process is needed. Measurement data (measurement time) for performing the filter process is necessary. Furthermore, the characteristics are often non-linear, and if the number of measurement points is small, the zero cross point cannot be determined with high precision. In order to measure the interference torque characteristics, in which the number of measurement points has been increased, a tremendous amount of time will be taken. For the purpose of responding to individual differences of devices, operation conditions, the environment, and time-dependent variations, in order to frequently measure the interference torque characteristics on the machine and not in the production process, the measurement time becomes a significant problem.

With respect to the above problems in the measurement precision and time reduction for measuring the interference torque characteristics, an effective means is proposed. The load torque components which are noise, include many steady components and period variation components that change in the rotation period of the photoconductive drum 1 and the driving roller 10. Furthermore, there are variation components that gradually increase or decrease, for which the periodicity cannot be confirmed by a measurement time of a few minutes.

Therefore, for the measurement of interference torque characteristics, an effective method is to change the period variation of the interference torque components, into a period variation that does not occur in the load torque components. For example, the period of the photoconductive drum and the period of the respective rollers are approximately 1 [Hz] through 40 [Hz]. The speed setting change of the secondary transfer roller 7 that is a level change performed at the time of property measurement, is changed into a sinusoidal waveform, and the sinusoidal wave period is set as approximately 0.2 [Hz]. The characteristics of the torque estimation value components that change in this period, are evaluated as the characteristics of interference torque components. Note that when the intermediate transfer belt 5 and the secondary transfer roller 7 are in the abutment state, the relative speed of the intermediate transfer belt 5 and the secondary transfer roller 7 (set speed of secondary transfer roller 7) is to be changed into a period waveform such as a sinusoidal wave or a triangular wave.

For example, when the secondary transfer roller 7 is in an abutment state, the set speed of the secondary transfer roller 7 is changed to a sinusoidal waveform of approximately 6 second periods, as illustrated in FIG. 8A. The interference torque characteristics at this time are illustrated in FIG. 8B.

According to changes in the set speed of the secondary transfer roller 7, the conveying forces of the intermediate transfer belt 5 and the secondary transfer roller 7 change into the same sinusoidal waveform. This property data can be extracted by using a low pass filter. Furthermore, there are many speed setting levels, and the zero cross point can be accurately determined. From the zero cross point time of FIG. 8B, the speed setting value of the secondary transfer roller 7 at the same time in FIG. 8A is set as the optimum value. Alternatively, the conveying force variation components of the intermediate transfer belt 5 and the secondary transfer roller 7 may be approximated to sinusoidal waves, and the zero cross point may be calculated even more accurately from the approximation results.

Figure 1:
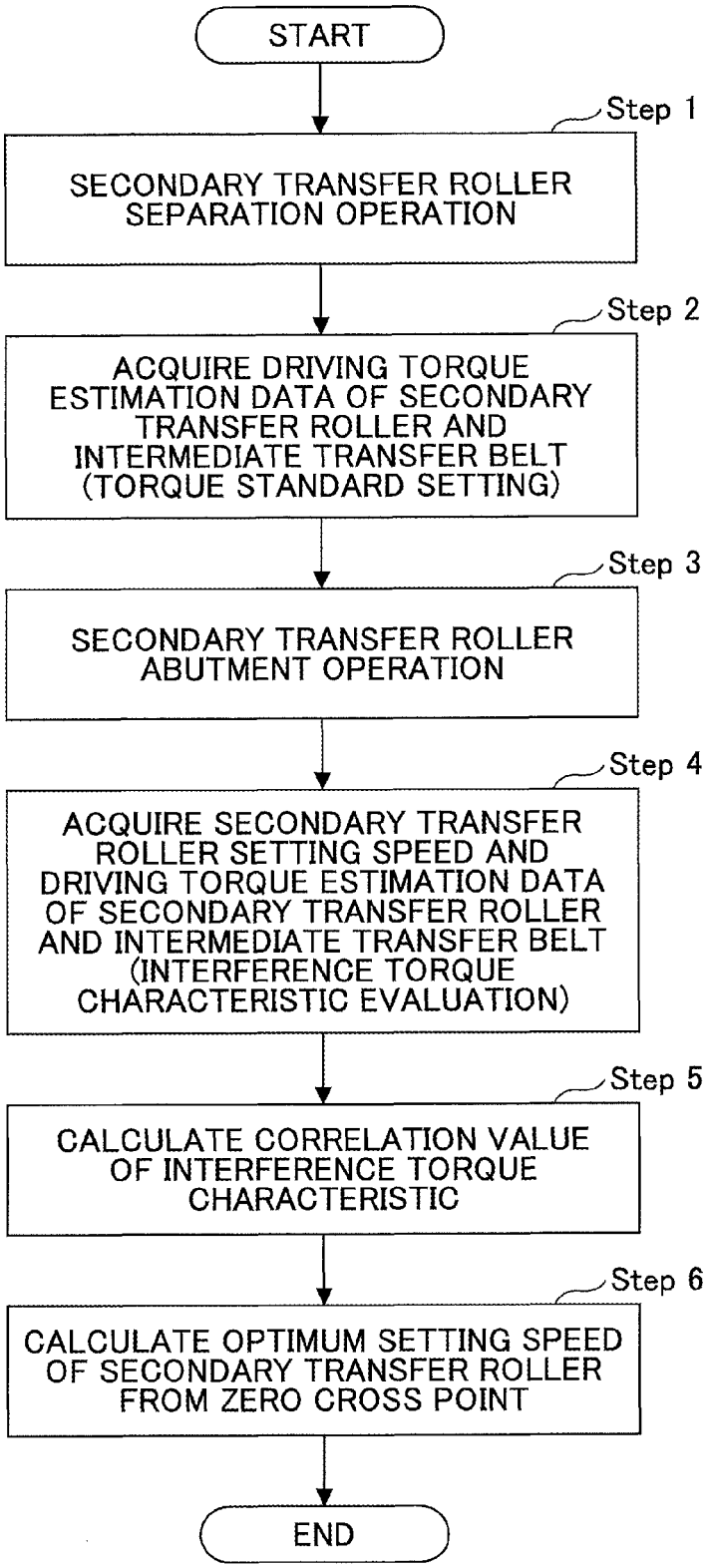
FIG. 1 is a flowchart of a control process performed for deriving an optimum value of a set speed of a secondary transfer roller.

FIG. 1 is a flowchart of a control process performed for deriving the optimum value of the set speed of the secondary transfer roller 7. This control process is performed at an initializing operation executed when the power of the image forming apparatus is turned on; however, the control process may be continuously performed at the time of the image output operation.

As illustrated in FIG. 1, when the control process for deriving the secondary transfer set speed is started, first, a separation operation of separating the secondary transfer roller 7 from the intermediate transfer belt 5 is performed (step 1). Then, the intermediate transfer belt 5 is drivingly controlled by a standard speed instruction value at the time of image forming, and furthermore, the secondary transfer roller 7 is drivingly controlled at a default speed. Note that in the case of the initial stage of device operation when there is no default speed profile, a constant value is used as the profile to execute the following deriving process.

Next, when the secondary transfer roller 7 and the intermediate transfer belt 5 are in a separated state, the torque transition data of the respective driving motors of the secondary transfer roller 7 and the intermediate transfer belt 5 is acquired (step 2). Then, according to need, a low pass filter process is performed on the torque transition data, and a torque estimation value estimated by this process is set as the standard torque at the time of monolithic driving.

Subsequently, an abutment operation of causing the secondary transfer roller 7 to abut the intermediate transfer belt 5 is performed (step 3). Then, an interference torque characteristic evaluation is performed (step 4). Specifically, the secondary transfer roller 7 is driven while changing the set speed of the secondary transfer roller 7 into a sinusoidal waveform. Based on the respective driving torque estimation values of the secondary transfer roller 7 and the intermediate transfer belt 5 at this time, the variation amount from the previous standard torque value is calculated. Next, by using a low pass filter, the components having the same period as the sinusoidal wave are extracted, and are set as the interference torque characteristics.

Based on the interference torque transition data of the secondary transfer roller 7 and the intermediate transfer belt 5, the correlation coefficient of the two data items of FIG. 8B is calculated (step 5), and it is confirmed whether the two data items have an inverse correlation characteristic. When the correlation coefficient is negative, it is determined as an inverse correlation, and the process proceeds to the next step; however, when the correlation coefficient is positive, the next step is not performed, and the control process of deriving a secondary transfer set speed is ended.

When the contact friction between the secondary transfer roller 7 and the intermediate transfer belt 5 is significantly low, and the secondary transfer roller 7 and the intermediate transfer belt 5 completely slip on each other, an inverse correlation will not be seen. In this state, the sheet conveying operation tends to become unstable, and therefore error information is sent to the image forming apparatus main unit.

Furthermore, when the secondary transfer roller 7 abuts the intermediate transfer belt 5, there are cases where the bearing part and the roller part deform excessively, and the load torque increases at both the secondary transfer roller 7 and the intermediate transfer belt 5. In this case, the correlation coefficient becomes positive, and this is also reported as a failure to the image forming apparatus by error information.

The optimum set speed of the secondary transfer roller 7 is derived from the zero cross point, and the default speed is changed to the optimum value (step 6). This optimum value represents a state where the surface speeds of the secondary transfer roller 7 and the intermediate transfer belt 5 match each other, and the interference torque is zero.

Meanwhile, in the secondary transfer process, when the transfer rate can be increased by setting a slight amount of interference torque, a default offset value may be added to the optimum value. A transfer rate is an index indicating how much of the toner amount on the intermediate transfer belt 5 has been transferred onto the sheet. It is known that when there is a slight difference in the surface speed, the toner can be transferred more easily by the friction between the sheet and the intermediate transfer belt 5.

Note that the optimum set speed of the secondary transfer roller 7 represents a state where the surface speeds of the secondary transfer roller 7 and the intermediate transfer belt 5 match each other and the interference torque becomes zero. By this optimum set speed, it is possible to suppress the speed variation of the intermediate transfer belt 5 caused by the interference torque. Meanwhile, even when there is a slight variation of the torque estimation value with respect to the monolithic driving torque, it is possible to reduce the speed variation of the intermediate transfer belt 5 caused by the interference torque.

For example, a relative speed of the secondary transfer roller 7 and the intermediate transfer belt 5 is derived, by which the variation amount of the torque estimation value with respect to the monolithic driving torque becomes less than 10 [Nm], and the rotational speed of the secondary transfer roller 7 by which the derived relative speed can be attained, is set as the secondary transfer set speed.

Furthermore, the set speed of the intermediate transfer belt 5 can be derived from the interference torque characteristic by a control unit provided in the image forming apparatus, and the rotational speed of the intermediate transfer belt 5 by which the relative speed can be attained, may be set as the intermediate transfer belt set speed.

Figure 20:
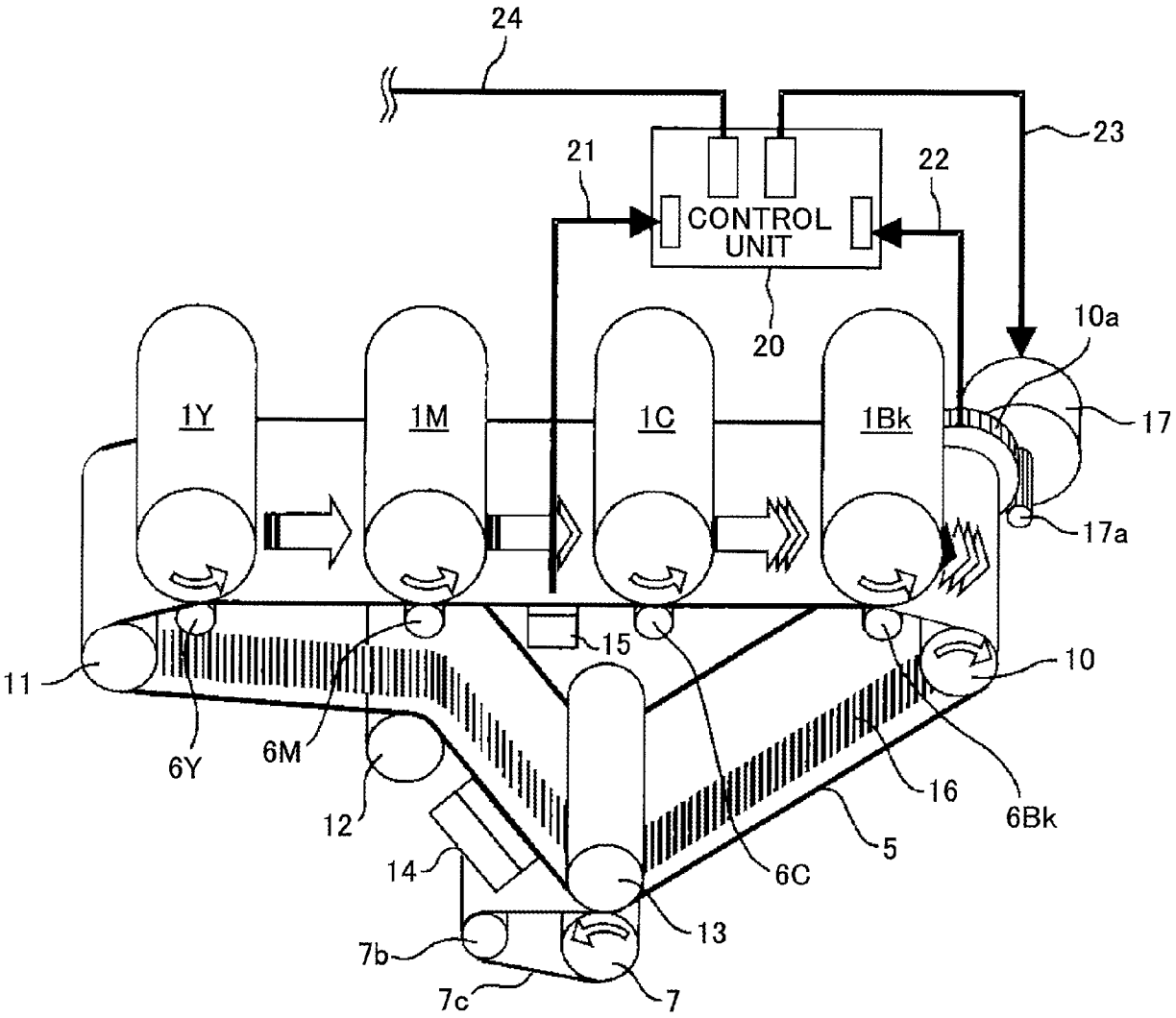
FIG. 20 is a perspective view of an intermediate transfer belt driving device and a motor control unit when a secondary transfer belt is used as the transfer member.
Figure 21:
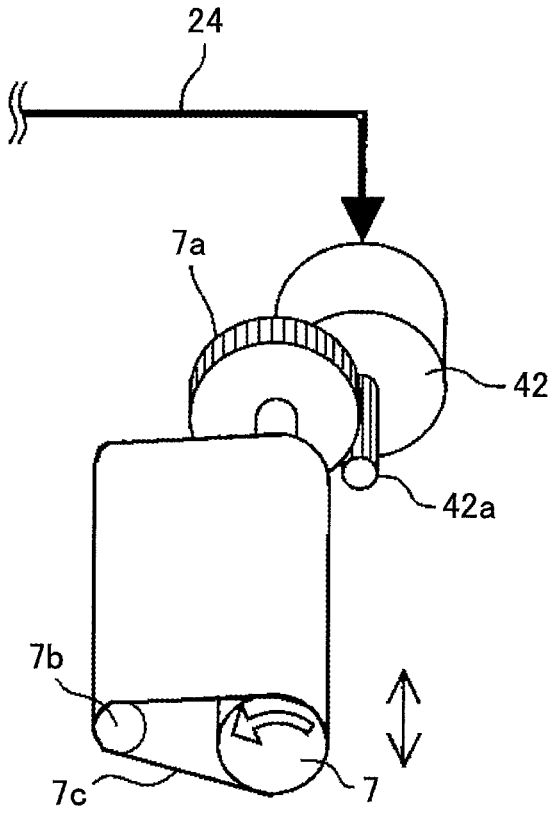
FIG. 21 illustrates a driving mechanism of a secondary transfer belt.

Note that in the present embodiment, a description is given of an image forming apparatus in which the intermediate transfer belt 5 is used as the belt image bearer; however, the present invention is not so limited. That is, the present invention is similarly applicable to an image forming apparatus of a direct transfer method, in which a photoconductive belt stretched around a plurality of stretching rollers including a driving roller is used, and a toner image is transferred from the photoconductive belt to a sheet, at a transfer part formed by causing the photoconductive belt and a transfer roller to contact each other. Furthermore, in the present embodiment, a description is given of an image forming apparatus in which the secondary transfer roller 7 is used as the transfer member; however, the present invention is not so limited. That is, the present invention is similarly applicable to an image forming apparatus in which a secondary transfer belt 7*c*, which is rotatably stretched around a plurality of stretching rollers including a driving roller, is used as the transfer member, as illustrated in FIGS. 20 and 21. Note that in FIGS. 20 and 21, the secondary transfer roller 7 functions as a driving roller for rotating the secondary transfer belt 7*c*, and the secondary transfer belt 7*c* is rotatably stretched around the secondary transfer roller 7 and a secondary transfer belt stretching roller 7*b*.

Second Embodiment

Next, a description is given of a second embodiment of the present invention applied to a printer that is an image forming apparatus. Note that the basic configuration and operations of the image forming apparatus according to the present embodiment are substantially the same as those of the image forming apparatus according to the first embodiment, and therefore descriptions thereof are omitted.

Figure 9A:
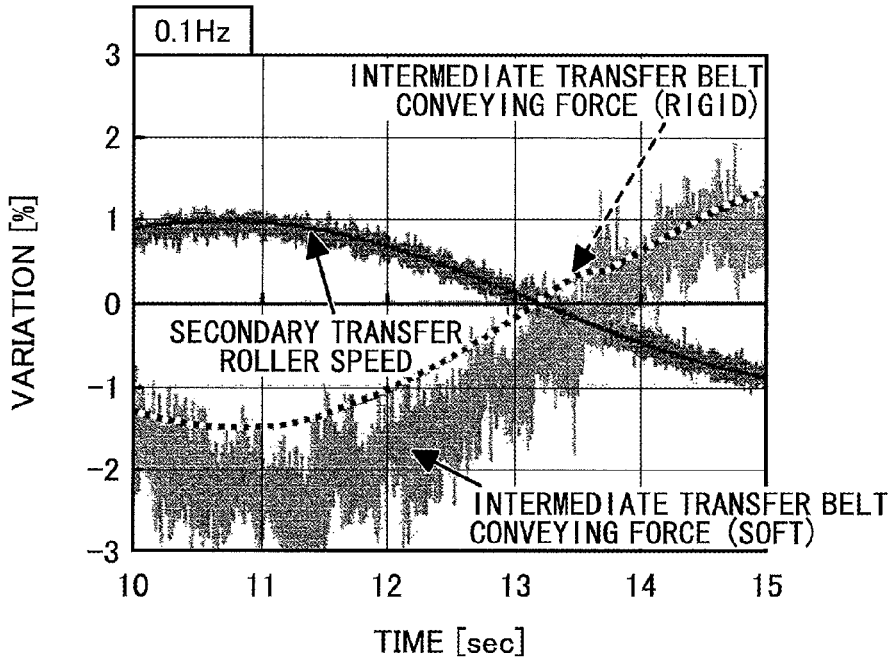
FIG. 9A is a graph obtained by actually measuring the variation transition of the secondary transfer roller speed and the intermediate transfer belt conveying force, in a case where the speed setting of the secondary transfer roller is changed to a sinusoidal waveform having a period of 0.1 [Hz]
Figure 9B:
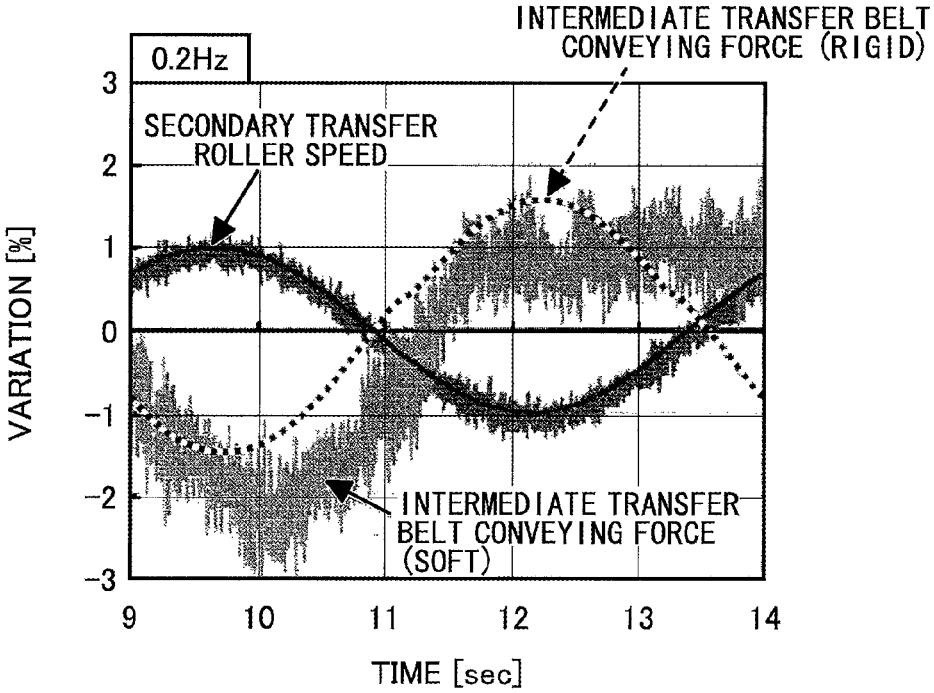
FIG. 9B is a graph obtained by actually measuring the variation transition of the secondary transfer roller speed and the intermediate transfer belt conveying force, in a case where the speed setting of the secondary transfer roller is changed to a sinusoidal waveform having a period of 0.2 [Hz]
Figure 9C:
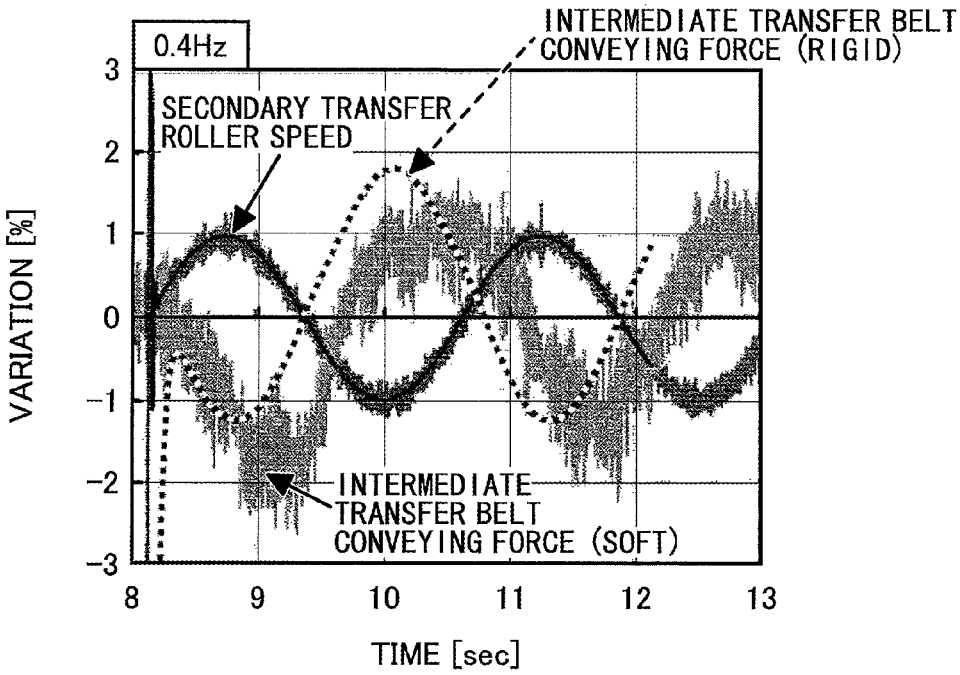
FIG. 9C is a graph obtained by actually measuring the variation transition of the secondary transfer roller speed and the intermediate transfer belt conveying force, in a case where the speed setting of the secondary transfer roller is changed to a sinusoidal waveform having a period of 0.4 [Hz]
Figure 9D:
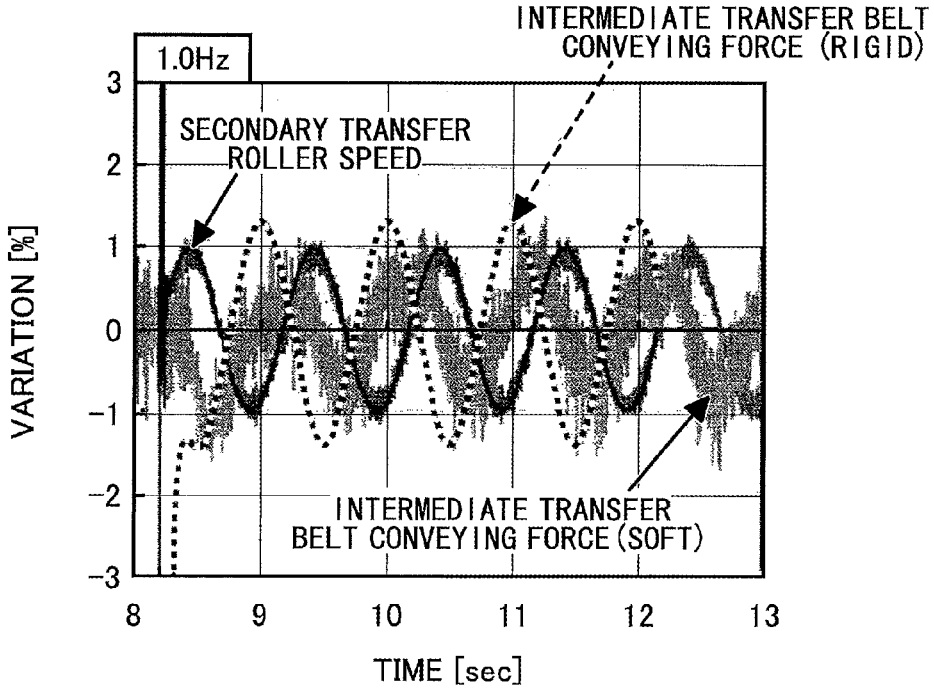
FIG. 9D is a graph obtained by actually measuring the variation transition of the secondary transfer roller speed and the intermediate transfer belt conveying force, in a case where the speed setting of the secondary transfer roller is changed to a sinusoidal waveform having a period of 1.0 [Hz]

FIGS. 9A through 9D indicate the implementation results of the interference torque characteristic evaluation performed by the process of step 4 of the flowchart of the control process for deriving the optimum value of the set speed of the secondary transfer roller 7 illustrated in FIG. 1. Note that FIG. 9A is a graph obtained by actually measuring the variation transition of the secondary transfer roller speed and the intermediate transfer belt conveying force, in a case where the speed setting of the secondary transfer roller 7 is changed to a sinusoidal waveform having a period of 0.1 [Hz]. FIG. 9B is a graph obtained by actually measuring the variation transition of the secondary transfer roller speed and the intermediate transfer belt conveying force, in a case where the speed setting of the secondary transfer roller 7 is changed to a sinusoidal waveform having a period of 0.2 [Hz]. FIG. 9C is a graph obtained by actually measuring the variation transition of the secondary transfer roller speed and the intermediate transfer belt conveying force, in a case where the speed setting of the secondary transfer roller 7 is changed to a sinusoidal waveform having a period of 0.4 [Hz]. FIG. 9D is a graph obtained by actually measuring the variation transition of the secondary transfer roller speed and the intermediate transfer belt conveying force, in a case where the speed setting of the secondary transfer roller 7 is changed to a sinusoidal waveform having a period of 1.0 [Hz].

In the interference torque characteristic evaluation, the secondary transfer roller 7 was driven while changing the speed setting of the secondary transfer roller 7 to a sinusoidal waveform, the period of the sinusoidal wave was set at 0.1 [Hz], 0.2 [Hz], 0.4 [Hz], 1.0 [Hz], and the variation transition of the secondary transfer roller speed and the intermediate transfer belt conveying force was actually measured. With respect to the intermediate transfer belt conveying force variation, two types of data are indicated, representing different levels of hardness and thicknesses of the rubber surface layer of the secondary transfer roller 7. Note that the intermediate transfer belt conveying force (soft) in the figures represents data when the rubber surface layer of the secondary transfer roller 7 has a low level of hardness and a large thickness. Furthermore, the intermediate transfer belt conveying force (rigid) in the figures represents data when the rubber surface layer of the secondary transfer roller 7 has a high level of hardness and a small thickness. As a matter of convenience in confirming the difference, the intermediate transfer belt conveying force (rigid) indicates the results obtained by removing noise from the actual measurement data and fitting the data by an approximation function.

The variation transition of the secondary transfer roller speed and the intermediate transfer belt conveying force (rigid) indicates an antiphase relationship, in which the intermediate transfer belt conveying force decreases as the secondary transfer roller speed increases, similar to that illustrated in FIGS. 8A and 8B. However, in the case of the intermediate transfer belt conveying force (soft), although the relationship is antiphase, there is a phase lag compared to the case of the intermediate transfer belt conveying force (rigid). Furthermore, this phase lag has a tendency of increasing as the sinusoidal wave period of the secondary transfer roller speed setting becomes shorter (as the frequency increases). As described above, when the response of the conveying force change of the intermediate transfer belt 5 is delayed with respect to the sinusoidal waveform speed change of the secondary transfer roller 7, the precision in adjusting the linear speed of the secondary transfer roller 7 is decreased in the flowchart process of FIG. 1.

The factor of the delay in the response of the conveying force change of the intermediate transfer belt 5, may be a shear deformation of the rubber of the secondary transfer roller 7 at the secondary transfer nip. The secondary transfer roller 7 includes a cylindrical hollow cored bar, an elastic layer made of an elastic material fixed on the outer peripheral surface of the cored bar, and a surface layer covering the outer peripheral surface. The metal forming the hollow cored bar may be stainless steel, aluminum, etc.; however, the material is not so limited.

As the elastic layer, epichlorohydrin rubber having conductivity, EPDM in which carbon is dispersed, Si rubber, NBR having an ion conductive function, urethane rubber, etc., may be used. The elastic material is preferably has a hardness that is a JIS-A hardness of approximately 40 [°] through 70 [°], and the elastic layer of the secondary transfer roller 7 of the rigid type has a thickness of 0.5 [mm] and a hardness of 70 [°]. Meanwhile, the elastic layer of the secondary transfer roller 7 of the soft type has a thickness of 5 [mm] and a hardness of 40 [°]. In the elastic layer of the secondary transfer roller 7 of the soft type, not only does a significant pressure deformation occur when abutting the intermediate transfer belt 5, but a significant shear deformation occurs in the rotational direction due to the speed difference in the intermediate transfer belt surface speed and the secondary transfer roller surface speed. Thus, when interference torque characteristic evaluation is performed by the process of step 4, in which the surface speed difference is changed to a sinusoidal waveform, the shear deformation of the elastic layer of the secondary transfer roller 7 also changes between a large deformation and a small deformation. The shear deformation of the elastic layer of the secondary transfer roller 7 is considered to cause the delay in the response of the conveying force change of the intermediate transfer belt 5.

Figure 10:
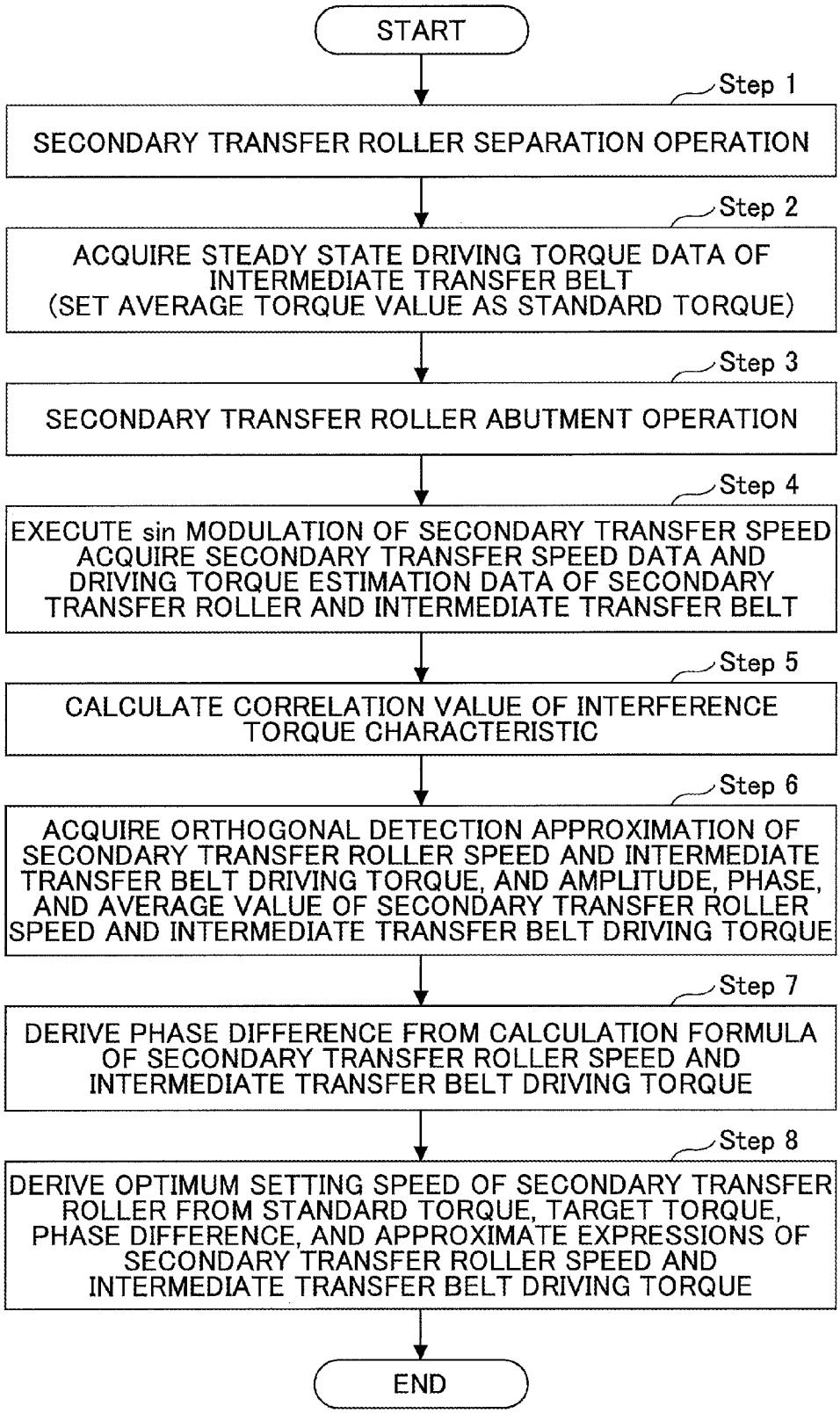
FIG. 10 is a flowchart of a process of deriving the optimum value of the set speed of the secondary transfer roller corresponding to the delay in the response of the conveying force variation by a soft type secondary transfer roller 7.

FIG. 10 is a flowchart of a process of deriving the optimum value of the set speed of the secondary transfer roller 7 corresponding to the delay in the response of the conveying force variation by the soft type secondary transfer roller 7. Note that the flowchart of FIG. 10 is different from the flowchart of FIG. 1 from the process of step 6 of deriving the optimum value of the set speed of the secondary transfer roller 7.

As illustrated in FIG. 10, when the control process for deriving the secondary transfer set speed is started, first, a separation operation of separating the secondary transfer roller 7 from the intermediate transfer belt 5 is performed (step 1). Then, the intermediate transfer belt 5 is drivingly controlled by a standard speed instruction value at the time of image forming, and furthermore, the secondary transfer roller 7 is drivingly controlled at a default speed. Note that in the case of the initial stage of device operation when there is no default speed profile, a constant value is used as the profile to execute the following deriving process.

Next, when the secondary transfer roller 7 and the intermediate transfer belt 5 are in a separated state, the torque transition data of the respective driving motors of the secondary transfer roller 7 and the intermediate transfer belt 5 is acquired (step 2). Then, according to need, a low pass filter process is performed on the torque transition data, and a torque estimation value estimated by this process is set as the standard torque at the time of monolithic driving. Subsequently, an abutment operation of causing the secondary transfer roller 7 to abut the intermediate transfer belt 5 is performed (step 3). Then, an interference torque characteristic evaluation is performed (step 4). Specifically, the secondary transfer roller 7 is driven while changing the set speed of the secondary transfer roller 7 into a sinusoidal waveform. Based on the respective driving torque estimation values of the secondary transfer roller 7 and the intermediate transfer belt 5 at this time, the variation amount from the previous standard torque value is calculated. Next, by using a los path filter, the components having the same period as the sinusoidal wave are extracted, and are set as the interference torque characteristics. Based on the interference torque transition data of the secondary transfer roller 7 and the intermediate transfer belt 5, the correlation value of the two data items is calculated (step 5).

Next, by an approximation calculation process according to the orthogonal detection of the secondary transfer roller speed and the intermediate transfer belt driving torque, the amplitude, the phase, and the average value of each of the secondary transfer roller speed and the intermediate transfer belt driving torque are acquired (step 6). Next, the phase difference is derived from the calculation formula of the secondary transfer roller speed and the intermediate transfer belt driving torque described below (step 7). Then, the optimum set speed of the secondary transfer roller is derived from the standard torque and the target torque of the intermediate transfer belt driving torque, the phase difference, and the approximation formula of the secondary transfer roller speed and the intermediate transfer belt driving torque (step 8).

A detailed description is given of the process of step 6 and onward of the flowchart in FIG. 10. First, the variation data y of the sinusoidal waveform period ω of each of the secondary transfer roller speed and the intermediate transfer belt driving torque (rotation torque conversion value of intermediate transfer belt conveying force) is acquired by performing an approximation calculation process according to orthogonal detection, based on the amplitude C, the phase θ, and the average value b. The intermediate transfer belt driving torque variation y1 is expressed by the following formula 1.

$$y_1=b_1+C_1\,\mathrm{Sin}(\omega t+\theta_1) \qquad \text{[Formula 1]}$$

Furthermore, the speed variation y2 of the secondary transfer roller 7 is expressed by the following formula 2. Note that as the secondary transfer roller speed, either an approximation calculation process performed on actually measured data or a setting value may be used.

$$y_2=b_2+C_2\,\mathrm{Sin}(\omega t+\theta_2) \qquad \text{[Formula 2]}$$

The aimed intermediate transfer belt driving torque value (target torque) Rt to be adjusted is obtained by adding the offset torque Roff to the standard torque Rb obtained by the process of step 2 in FIG. 10, as indicated by the following formula 3. Note that the offset torque Roff is determined in advance in consideration of transfer properties and the paper type of the conveyed sheet.

$$R_t=R_b+R_{off} \qquad \text{[Formula 3]}$$

In the data of the intermediate transfer belt driving torque variation in the process of step 6 in FIG. 10, the time tr at which the intermediate transfer belt driving torque becomes a value Rt is calculated by the following formula 4.

$$t_r=\frac{\sin^{-1}\frac{Rt-y_1}{c_1}-\theta_1}{\omega} \qquad \text{[Formula 4]}$$

In the intermediate transfer belt driving torque variation in one period of a sinusoidal waveform, there are two time points at which the torque becomes a value Rt, and either time point may be used. The obtained time tr is assigned to the time t of the above formula 2, and the optimum speed of the secondary transfer roller 7 is derived.

Third Embodiment

Next, a description is given of a third embodiment of the present invention applied to a printer that is an image forming apparatus. Note that the basic configuration and operations of the image forming apparatus according to the present embodiment are substantially the same as those of the image forming apparatus according to the first embodiment, and therefore descriptions thereof are omitted.

Figure 11:
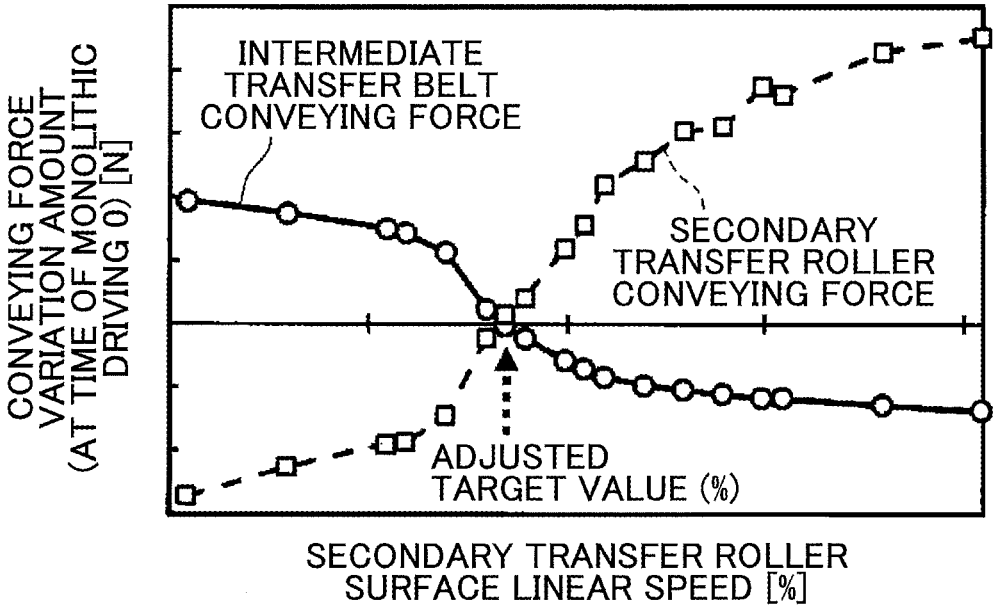
FIG. 11 illustrates the relationship between the abutment state of the secondary transfer roller and the interference torque.

FIG. 11 illustrates the relationship between the abutment state of the secondary transfer roller 7 and the interference torque according to the present embodiment. The horizontal axis of FIG. 11 indicates the speed setting value of the secondary transfer roller 7, which is indicated by a percentage assuming that the standard setting value is "0". The standard setting value is a value at which the roller surface speed of the secondary transfer roller 7 in an abutment state is assumed to match the surface speed of the intermediate transfer belt 5 based on the design value. Actually, the surface speed does not become the same as the standard setting value, due to the roller tolerance, variations in the contact pressure, the environment, and time-dependent variations. The vertical axis in FIG. 11 indicates the conveying force on the respective surfaces of the secondary transfer roller 7 and the intermediate transfer belt 5. The conveying force is a value obtained by converting the driving torque [Nm] of the secondary transfer roller 7 and the intermediate transfer belt 5, into the conveying force [N] on the surface based on design values such as the roller diameter. The respective torques of the secondary transfer roller 7 and the intermediate transfer belt 5 are converted as a matter of convenience, in order to express these values on the same axis in the graph. Each torque is obtained by converting the torque estimation value of the intermediate transfer driving motor 17 into the intermediate transfer belt conveying force, in consideration of the deceleration ratio, the driving roller diameter, and the thickness of the intermediate transfer belt 5. Furthermore, the torque estimation value of the secondary transfer driving motor 42 is converted into the secondary transfer roller surface conveying force, in consideration of the deceleration ratio and the secondary transfer driving roller. The torque estimation value is a load torque value calculated based on a current value of the driving motor or a PWM instruction value to the driving motor, and the actual rotational speed value. In a state where the respective motors are controlled with high precision at a constant speed or a default speed, the load torque value can be calculated from only the current value and the PWM instruction value.

A description is given of the interference torque in FIG. 11. In a state where the secondary transfer roller 7 is separated from the intermediate transfer belt 5, the secondary transfer roller 7 and the intermediate transfer belt 5 are respectively driven according to feedback control at constant speeds. Then, in a state where there is no interference torque at all, the respective torques of the intermediate transfer belt 5 and the secondary transfer roller 7 are set to be the standard "0", as an intermediate transfer monolithic conveying torque and a secondary transfer monolithic driving torque. While the intermediate transfer belt 5 and the secondary transfer roller 7 are respectively subjected to feedback control at a constant speed, the secondary transfer roller 7 abuts the intermediate transfer belt 5. At this time, the surface speed of the secondary transfer roller 7 does not match the surface speed of the intermediate transfer belt 5, due to factors such as tolerance. For example, when the secondary transfer roller 7 abuts the intermediate transfer belt 5 and the secondary transfer roller 7 is largely deformed, and the surface speed increases, the secondary transfer driving torque increases, and the conveying torque of the intermediate transfer belt 5 decreases. The inverse correlation of the torque transitions of the secondary transfer roller 7 and the intermediate transfer belt 5 corresponds to the interference torque. Furthermore, in FIG. 11, the interference torque is expressed by being converted into a conveying force.

FIG. 11 expresses the transition of the conveying force, obtained from the intermediate transfer belt driving torque and the secondary transfer roller driving torque, in a case where the set speed of the secondary transfer roller 7 is changed. The interference torque and the converted conveying force of the secondary transfer roller 7 are in an inverse correlation with those of the intermediate transfer belt 5. According to these interference torque characteristics (here, the interference conveyance force characteristics), the secondary transfer roller speed setting value of the zero cross point will have an optimum value of near 1.5 [%] in the property example of FIG. 11. Under optimum conditions, there is no change in the driving conveying force between monolithic driving and abutment driving, and stable driving operations can be realized in driving the intermediate transfer belt 5 and conveying the paper.

Note that when the difference between the driving speed of the secondary transfer roller 7 and the driving speed of the intermediate transfer belt 5 becomes greater than a certain range, slipping occurs at the surfaces of the secondary transfer roller 7 and the intermediate transfer belt 5. In a completely slipped state, the contact friction between the secondary transfer roller 7 and the intermediate transfer belt 5 becomes significantly low. Therefore, an inverse correlation cannot be seen, and the inverse correlation relationship between the secondary transfer roller speed and the intermediate transfer belt driving torque changes. In such a state, the paper conveying operation tends to become unstable. In the present embodiment, the set speed of the secondary transfer roller 7 is derived on-machine, from the above interference torque character.

The measurement of the interference torque characteristic illustrated in FIG. 11 is performed by using, as a standard, the torque estimation value in a state where the secondary transfer roller 7 is separated. Then, the secondary transfer roller 7 abuts the intermediate transfer belt 5, and several levels of set speeds are set. The amount, by which the torque estimation value changes from the standard value in each level, is plotted as an interference torque, and the characteristics of the interference torque can be measured. At this time, the driving speed of the secondary transfer roller 7 is to be modulated into the sinusoidal waveform illustrated in FIG. 8A, within a range where the inverse correlation relationship is maintained. However, when the difference between the driving speed of the secondary transfer roller 7 and the driving speed of the intermediate transfer belt 5 becomes greater than a certain range, slipping occurs at the surfaces of the secondary transfer roller 7 and the intermediate transfer belt 5. In a completely slipped state, the contact friction between the secondary transfer roller 7 and the intermediate transfer belt 5 becomes significantly low. Therefore, the inverse correlation relationship between the secondary transfer roller speed and the intermediate transfer belt driving torque changes. In such a state, the paper conveying operation tends to become unstable, which is inappropriate for sinusoidal waveform driving. Therefore, in the present embodiment, the method of deriving the optimum value of the secondary transfer roller speed is performed a plurality of times to increase the adjustment precision. The purpose of the method of deriving the optimum value of the secondary transfer roller speed is divided into coarse adjustment and fine adjustment. Coarse adjustment is performed within a secondary transfer roller speed range in which slipping does not occur, according to secondary transfer roller sinusoidal waveform driving. Fine adjustment is performed by a method of deriving the optimum value of the secondary transfer roller speed within a secondary transfer roller speed range in which slipping does not occur, to obtain the secondary transfer roller speed with high precision. By changing the adjustment purpose each time the deriving method is performed, high-precision adjustment can be achieved.

Figure 12:
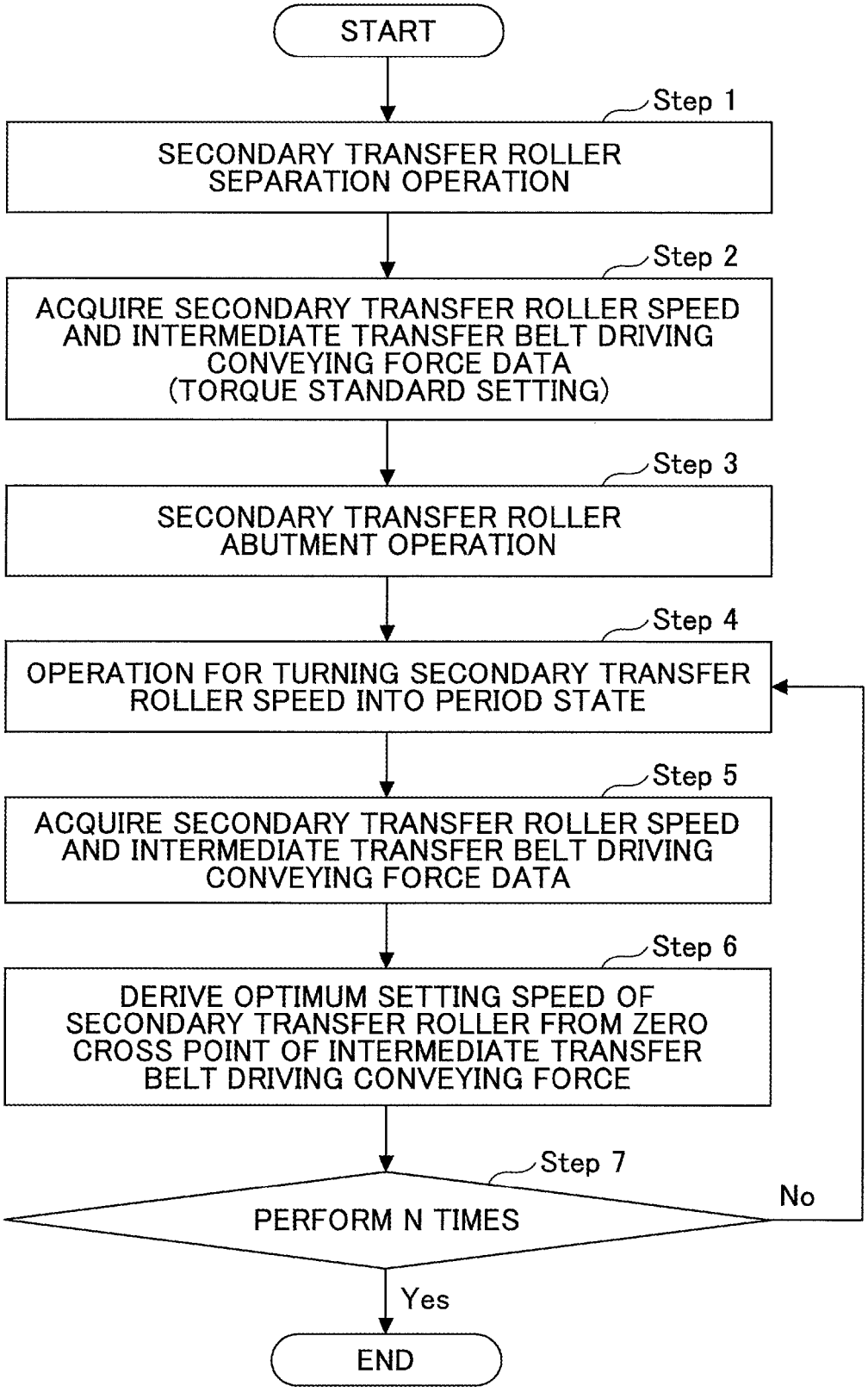
FIG. 12 is a flowchart of a method of deriving a speed setting of the secondary transfer roller.

FIG. 12 is a flowchart of the method of deriving a speed setting of the secondary transfer roller 7 illustrated in FIGS. 8A and 8B. The present operation is performed at an initializing operation executed when the power of the image forming apparatus is turned on. Furthermore, the method may be continuously performed at the time of the image output operation.

First, a separation operation of separating the secondary transfer roller 7 from the intermediate transfer belt 5 is performed (step 1). Then, the intermediate transfer belt 5 is drivingly controlled by a standard speed instruction value at the time of image forming, and furthermore, the secondary transfer roller 7 is drivingly controlled at a default speed. Next, when the secondary transfer roller 7 and the intermediate transfer belt 5 are in a separated state, the secondary transfer roller speed and the driving conveying force transition data of the intermediate transfer belt 5 are acquired (step 2). According to need, a low pass filter process is performed on the conveying force transition data. The value of this conveying force is set as the standard conveying force at the time of monolithic driving. Subsequently, an abutment operation of causing the secondary transfer roller 7 to abut the intermediate transfer belt 5 is performed (step 3). Then, the secondary transfer roller 7 is driven such that the set speed of the secondary transfer roller 7 becomes periodic (step 4), and the secondary transfer roller speed when driving is performed in step 4 and the drive conveying force transition data of the intermediate transfer belt 5 are acquired (step 5). Then, a low pass filter process is performed on the conveying force transition data according to need. The optimum set speed of the secondary transfer roller 7 is derived from the zero cross point, and the default speed is changed to the optimum value (step 6). The zero cross point is the intersection point where the standard conveying force at the time of driving motor monolithic driving of the intermediate transfer belt 5 of step 2 and the driving conveying force transition data of the intermediate transfer belt 5 of step 5, match each other. The optimum value of the secondary transfer roller speed represents a state where the surface speed of the secondary transfer roller 7 and the surface speed of the intermediate transfer belt 5 match each other, and the interference torque of the intermediate transfer belt 5 is zero. However, in the secondary transfer process, when the transfer rate can be increased by setting a slight amount of interference torque, a default offset value may be added to the optimum value. Next, it is determined whether the adjustment of step 4 through step 6 has been performed an N number of times (step 7). When the adjustment has not been performed an N number of times (No in step 7), the adjustment of step 4 through step 6 is performed again. When the adjustment has been performed an N number of times (Yes in step 7), the flowchart is completed at step 7.

Figure 13:
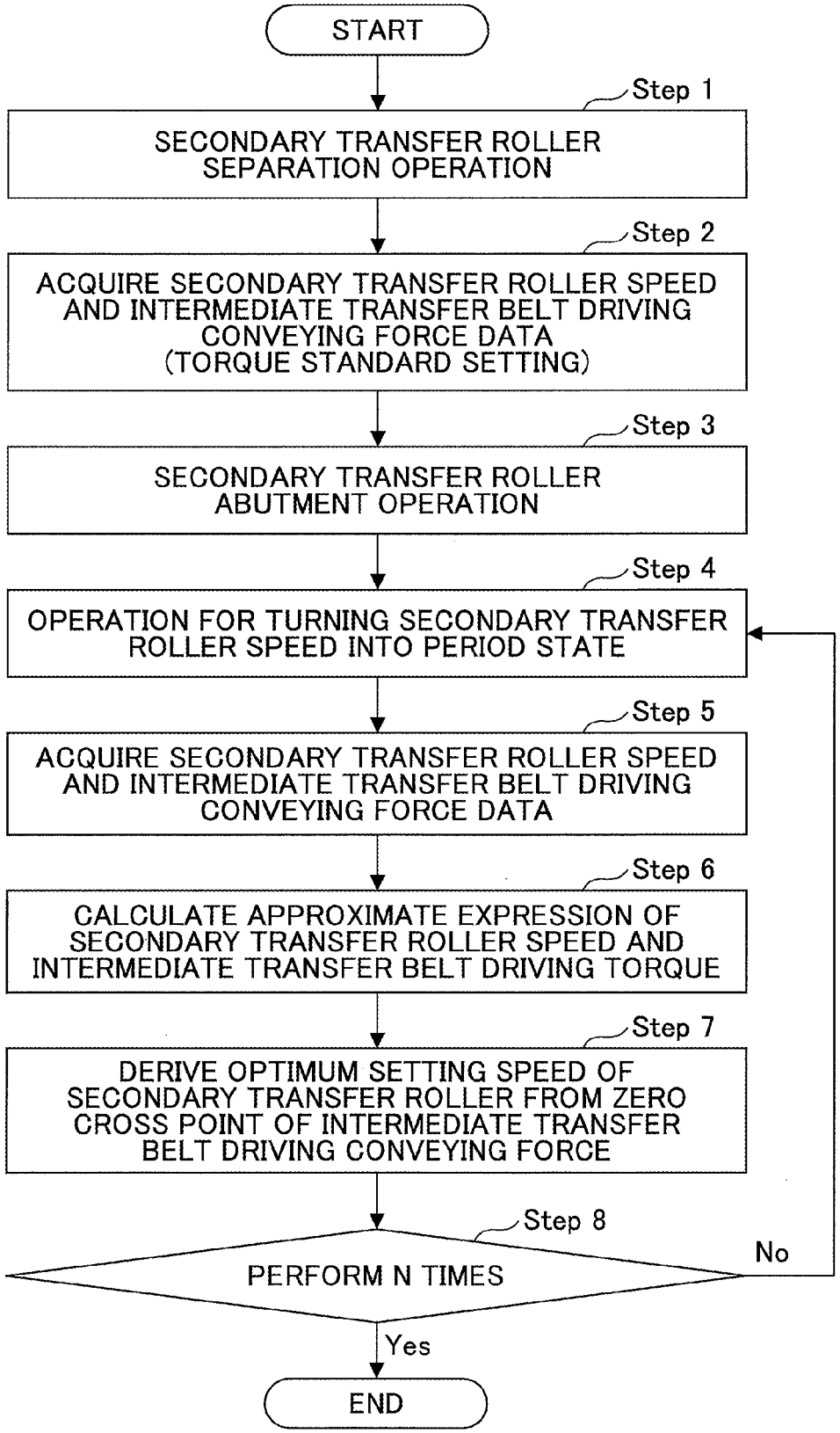
FIG. 13 is a flowchart using an approximation formula of the method of deriving the speed setting of the secondary transfer roller.

FIG. 13 is a flowchart using an approximation formula of the method of deriving the speed setting of the secondary transfer roller 7 illustrated in FIGS. 8A and 8B. FIG. 13 is the same as the flowchart of FIG. 12 in steps 1 through 5, and therefore only the differences from step 6 and onward are described.

An approximation formula of the secondary transfer roller speed and the intermediate transfer belt driving conveying force is calculated (step 6). The optimum set speed of the secondary transfer roller 7 is derived from the zero cross point, and the default speed is changed to the optimum value (step 7). The zero cross point is the intersection point where the standard conveying force at the time of driving motor monolithic driving of the intermediate transfer belt 5 of step 2 and the approximation formula of the driving conveying force of the intermediate transfer belt 5 of step 6 match each other. The optimum value of the secondary transfer roller speed represents a state where the surface speed of the secondary transfer roller 7 and the surface speed of the intermediate transfer belt 5 match each other, and the interference torque of the intermediate transfer belt 5 is zero. However, in the secondary transfer process, when the transfer rate can be increased by setting a slight amount of interference torque, a default offset value may be added to the optimum value. Next, it is determined whether the adjustment of step 4 through step 7 has been performed an N number of times (step 8). When the adjustment has not been performed an N number of times (No in step 8), the adjustment of step 4 through step 7 is performed again. When the adjustment has been performed an N number of times (Yes in step 8), the flowchart is completed at step 8.

Fourth Embodiment

Next, a description is given of a fourth embodiment of the present invention applied to a printer that is an image forming apparatus. Note that the basic configuration and operations of the image forming apparatus according to the present embodiment are substantially the same as those of the image forming apparatus according to the first embodiment, and therefore descriptions thereof are omitted.

Figure 14A:
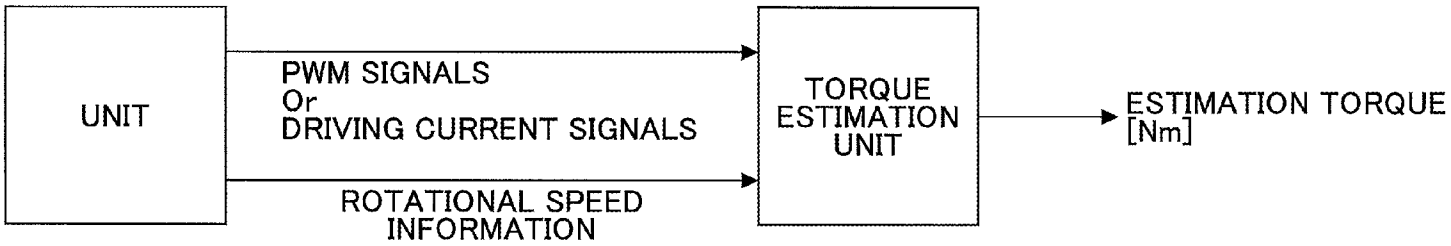
FIGS. 14A through 14D illustrate signals usable as alternative signals of the interference torque.

With reference to FIGS. 14A through 14D, a description is given of signals usable as alternative signals of the interference torque. In the present embodiment, a description is given of signals that are useful as an adjustment index, other than the load torque information. In FIGS. 3 and 11, a description is given of the interference torque caused by the difference in surface speed of the intermediate transfer belt 5 and the secondary transfer roller 7. The interference torque is the torque measurement value, the driving current of the motor, the PWM value of the motor, the torque estimation value calculated based on the actual speed information, or any load torque, as the conveying force on the surface of the secondary transfer roller 7 or the intermediate transfer belt 5 (FIG. 14A). In the block line diagram of FIG. 14B, the flow of signals under feedback control is expressed in a pattern diagram. In a state where the respective motors are controlled with high precision at a constant speed or a default speed, the information of the driving current value, the PWM value, and the controller instruction value can also be used as an index for adjustment, similar to the load torque (torque measurement value, torque estimation value). The reason is that the variation in the interference torque by the surface speed difference between the intermediate transfer belt 5 and the secondary transfer roller 7, is the variation in the frequency band included in the control band of the feedback control. Therefore, by performing feedback control, the driving speed information is reflected to the controller. That is, in each of the upstream signals, the interference torque information is reflected, and therefore these signals can be applied as adjustment indexes. Examples of signals that can be applied as the conveying force are a motor current instruction value, a motor current actual measurement value, a motor PWM instruction value, a motor PWM actual measurement value, a motor torque actual measurement value, a motor torque estimation value, a roller torque actual measurement value, a roller torque estimation value, etc.

Figure 14B:
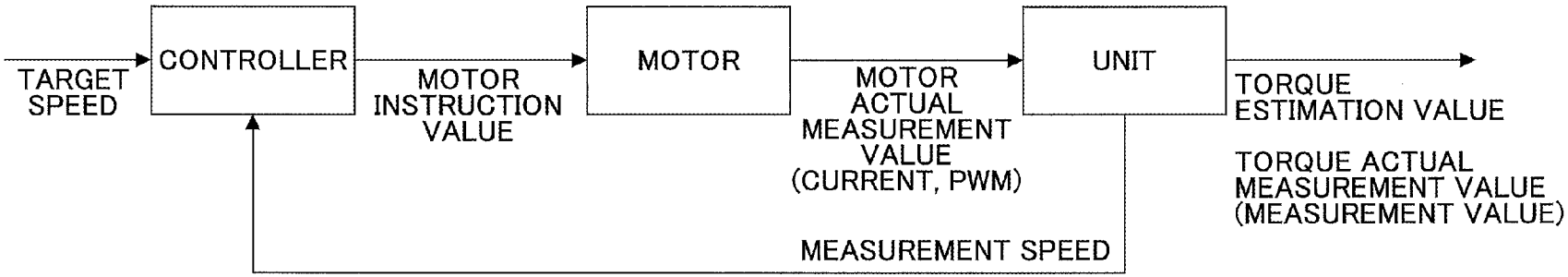
Figure 14C:
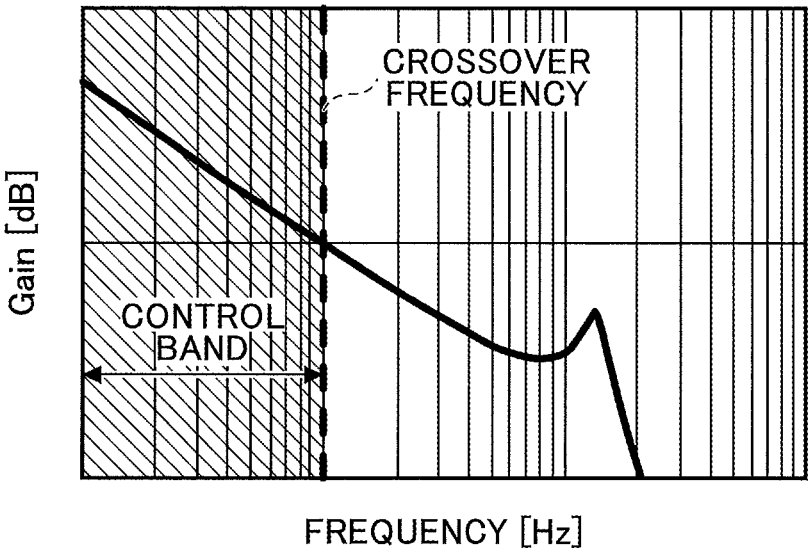
Figure 14D:
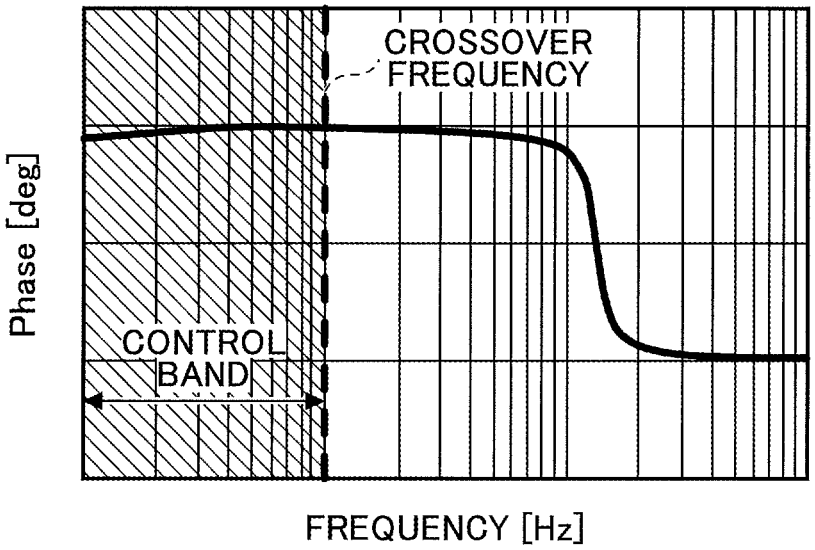

FIGS. 14C and 14D are examples of board line diagrams of secondary system open loop properties in the block line diagram of FIG. 14B. In this case, it is assumed that the gain margin and the phase margin satisfy the safety of feedback control. The frequency on the lower side of the crossover frequency of the gain properties, is the control band. In the frequency of the control band, the vibration due to the speed variation can be suppressed. The vibration components that become noise are periodic variation components that change in the rotation period, such as the resonance in the mechanical system, an encoder reading error, etc. Thus, when changing the speed into a sinusoidal waveform, an effective method is to make the period sufficiently lower than the crossover frequency so that the vibration components become noise and are suppressed, and to measure the speed in the state where noise is suppressed.

Figure 15A:
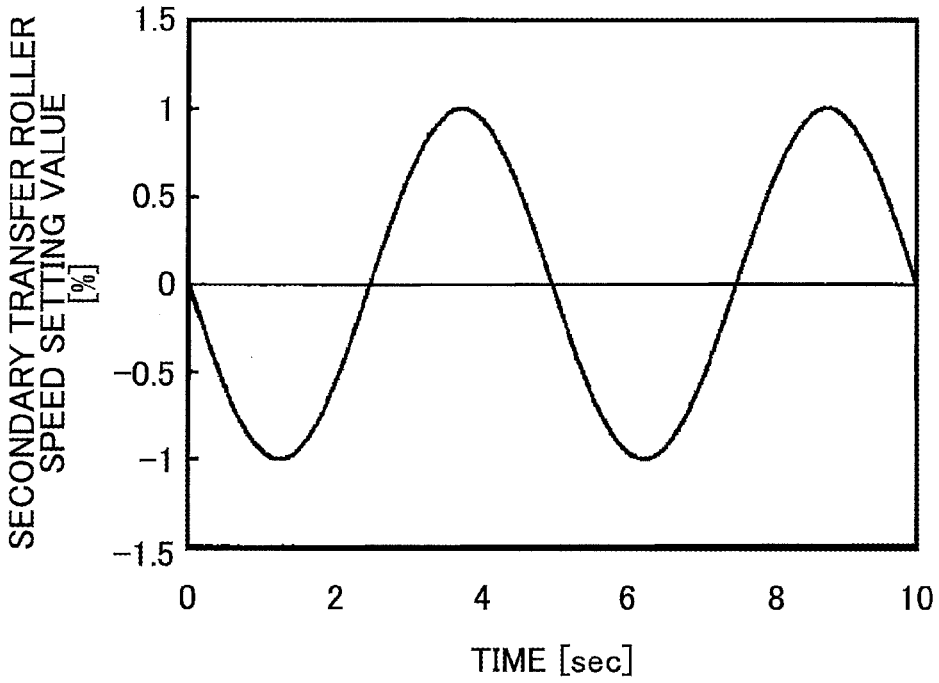
FIGS. 15A and 15B illustrate the basic process of deriving the optimum value of the speed setting of the secondary transfer roller.
Figure 15B:
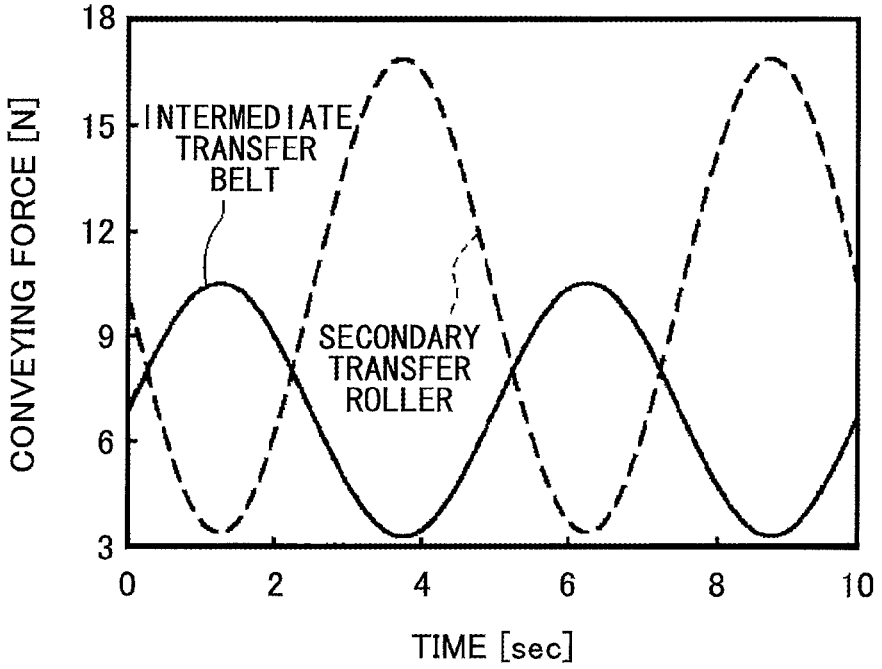
Figure 16A:
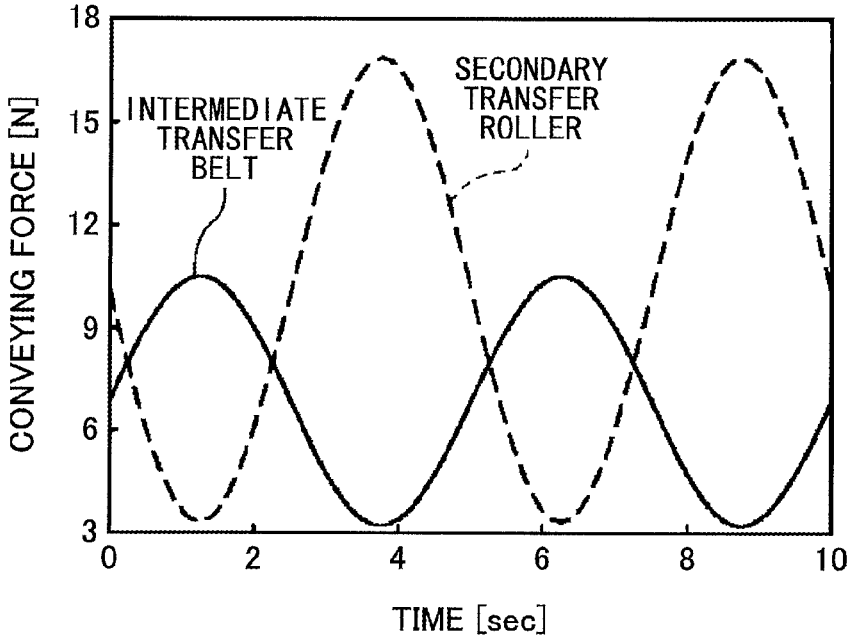
FIGS. 16A through 16D illustrate examples of alternative signals of the interference torque for deriving the optimum value of the speed setting of the secondary transfer roller.
Figure 16B:
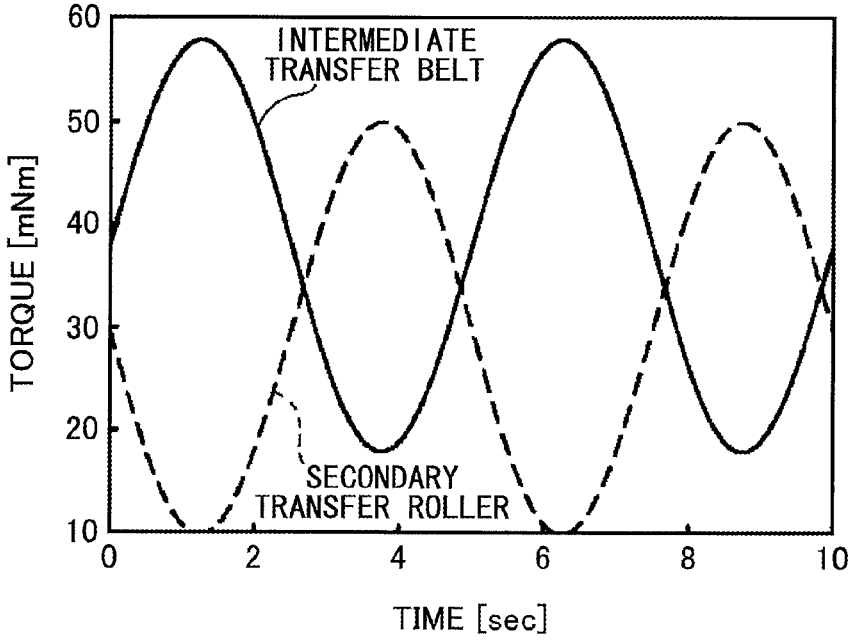
Figure 16C:
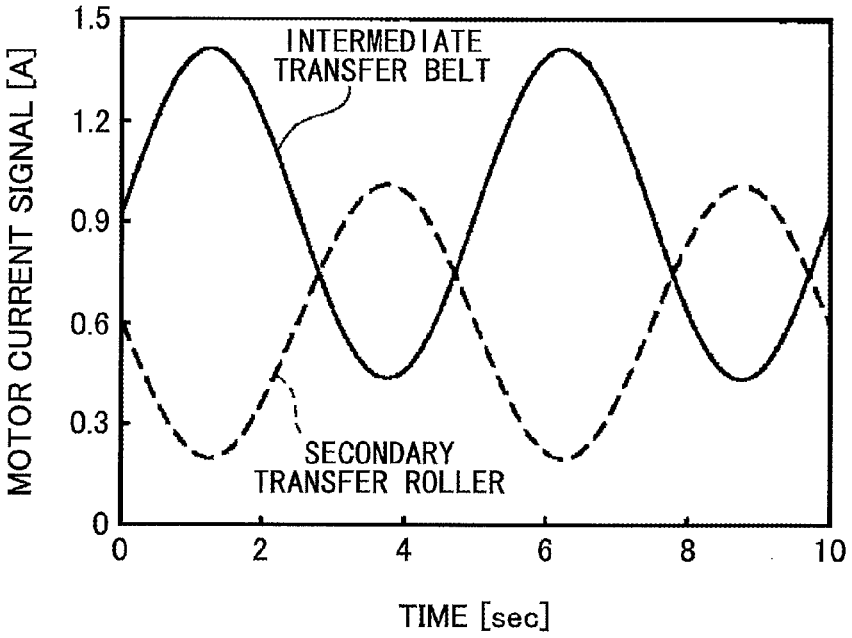
Figure 16D:
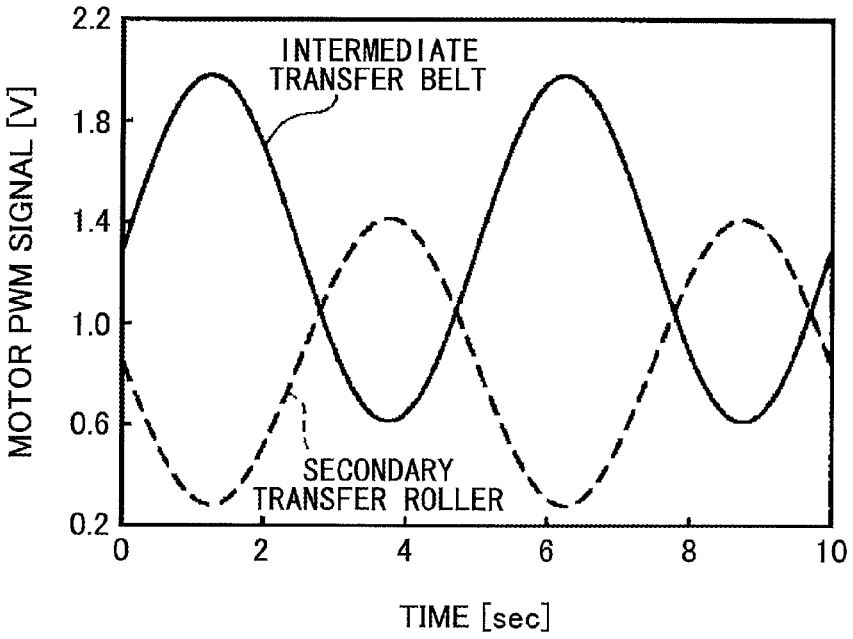

FIGS. 15A and 15B illustrate the basic process of deriving the optimum value of the speed setting of the secondary transfer roller 7 according to the present embodiment. The conveying force is taken as an example in describing the basic process of deriving the optimum value of the speed setting of the secondary transfer roller 7 according to the present embodiment. Note that the conveying force is an example of signals applicable as a conveying force described with reference to FIGS. 14A through 14D.

In the measurement of the interference torque characteristic illustrated in FIGS. 15A and 15B, the conveying force in a state where the secondary transfer roller 7 is separated, is used as the standard. Then, the secondary transfer roller 7 abuts the intermediate transfer belt 5, and several levels of the set speed are set. The amount, by which the conveying force changes from the standard value in each level, is plotted as an interference torque, and the characteristics of the interference torque can be measured. However, the motor driving torque in the actual device does not only include the interference torque components, but also many other load torque components. Examples of a load torque component are a contact load of the cleaning blade of the belt cleaning device 14, a contact load of the photoconductive drum 1, an acceleration and deceleration torque for correcting the variations in the speed of the secondary transfer roller 7 and the intermediate transfer belt 5, etc. In order to remove such noise components and determine the interference torque component, a filter process is needed. Measurement data (measurement time) for performing the filter process is necessary. Furthermore, the characteristics are often non-linear, and if the number of measurement points is small, the zero cross point cannot be determined with high precision. The measurement of the interference torque characteristics, which have an increased number of measurement points, takes a tremendous amount of time. For the purpose of responding to individual differences of devices, operation conditions, the environment, and time-dependent variations, in order to frequently measure the interference torque characteristics on-machine and not in the production process, the measurement time becomes a significant problem.

With respect to the above problems in the measurement precision and time reduction for measuring the interference torque characteristics, an effective means is proposed. The load torque components which are noise, include many steady components and period variation components that change in the rotation period of the photoconductive drum 1 and the driving roller 10. Furthermore, there are variation components that gradually increase or decrease, for which the periodicity cannot be confirmed by a measurement time of a few minutes. Therefore, for the measurement of interference torque characteristics, an effective method is to change the period variation of the interference torque components, into a period variation that does not occur in the load torque components. For example, the period of the photoconductive drum and the period of the respective rollers are approximately 1 [Hz] through 40 [Hz]. The speed setting change of the secondary transfer roller 7 that is a level change performed at the time of property measurement, is changed into a sinusoidal waveform, and the sinusoidal wave period is set as approximately 0.2 [Hz]. The characteristics of the torque estimation value components that change in this period, are evaluated as the characteristics of interference torque components.

When the secondary transfer roller 7 is in an abutment state, the set speed of the secondary transfer roller 7 is changed to a sinusoidal waveform of approximately 6 second periods, as illustrated in FIG. 15A. The interference torque characteristics at this time are illustrated in FIG. 15B. According to changes in the set speed of the secondary transfer roller 7, the conveying forces of the intermediate transfer belt 5 and the secondary transfer roller 7 change into the same sinusoidal waveform. This property data can be extracted by using a low pass filter. Furthermore, there are many speed setting levels, and the zero cross point can be accurately determined. From the zero cross point time of FIG. 15B, the speed setting value of the secondary transfer roller 7 at the same time in FIG. 15A is set as the optimum value. Alternatively, the conveying force variation components of the intermediate transfer belt 5 and the secondary transfer roller 7 may be approximated to sinusoidal waves, and the zero cross point may be calculated even more accurately from the approximation results. The following is a summary of the procedures of deriving the optimum value of the secondary transfer roller speed in the sinusoidal wave. First, the sinusoidal wave of the belt conveying force (or driving torque) and the zero cross point of the monolithic driving are calculated. Next, the secondary transfer roller speed corresponding to the measurement time at the zero cross point is calculated.

The measurement of the interference torque characteristic illustrated in FIG. 11 is performed by using, as a standard, the conveying force in a state where the secondary transfer roller 7 is separated. Then, the secondary transfer roller 7 abuts the intermediate transfer belt 5, and several levels of set speeds are set. The amount, by which the conveying force changes from the standard value in each level, is plotted as an interference torque, and the characteristics of the interference torque can be measured. At this time, the driving speed of the secondary transfer roller 7 is to be modulated into the sinusoidal waveform illustrated in FIG. 15A, within a range where the inverse correlation relationship is maintained. However, when the difference between the driving speed of the secondary transfer roller 7 and the driving speed of the intermediate transfer belt 5 becomes greater than a certain range, slipping occurs at the surfaces of the secondary transfer roller 7 and the intermediate transfer belt 5. In a completely slipped state, the contact friction between the secondary transfer roller 7 and the intermediate transfer belt 5 becomes significantly low. Therefore, the inverse correlation relationship between the secondary transfer roller speed and the intermediate transfer belt driving torque changes. In such a state, the paper conveying operation tends to become unstable, which is inappropriate for sinusoidal waveform driving.

Therefore, in the present embodiment, the method of deriving the optimum value of the secondary transfer roller speed is performed a plurality of times to increase the adjustment precision. The purpose of the method of deriving the optimum value of the secondary transfer roller speed is divided into coarse adjustment and fine adjustment. Coarse adjustment is performed within a secondary transfer roller speed range in which slipping does not occur, according to secondary transfer roller sinusoidal waveform driving. Fine adjustment is performed by a method of deriving the optimum value of the secondary transfer roller speed within a secondary transfer roller speed range in which slipping does not occur, to obtain the secondary transfer roller speed with high precision. By changing the adjustment purpose each time the deriving method is performed, high-precision adjustment can be achieved.

FIGS. 16A through 16D illustrate examples of alternative signals of the interference torque for deriving the optimum value of the speed setting of the secondary transfer roller 7 according to the present embodiment. In this example, a description is given of applying conveying force alternative signals in the basic process of deriving the optimum value of the speed setting of the secondary transfer roller 7 illustrated in FIGS. 15A and 15B. Similar to FIGS. 15A and 15B, FIG. 16A through 16D express the conveying force of the secondary transfer roller 7 and the intermediate transfer belt 5 (FIG. 16A), the torque (FIG. 16B), the motor current signals (FIG. 16C), and the motor PWM signals (FIG. 16D), which are obtained by performing sinusoidal wave modulation on the rotational speed of the secondary transfer roller 7 or the intermediate transfer belt 5 by 0.2 [Hz] and an amplitude of 1 [%]. In any of the signals, the waveform changes in the same period according to variations in the secondary transfer roller speed, and therefore an observation can be made of a change from signals of monolithic driving in a state where the secondary transfer roller 7 or the intermediate transfer belt 5 is separated. Therefore, these are applicable as conveying force alternative signals for deriving the optimum value of the speed setting of the secondary transfer roller 7 in FIGS. 15A and 15B.

Figure 17:
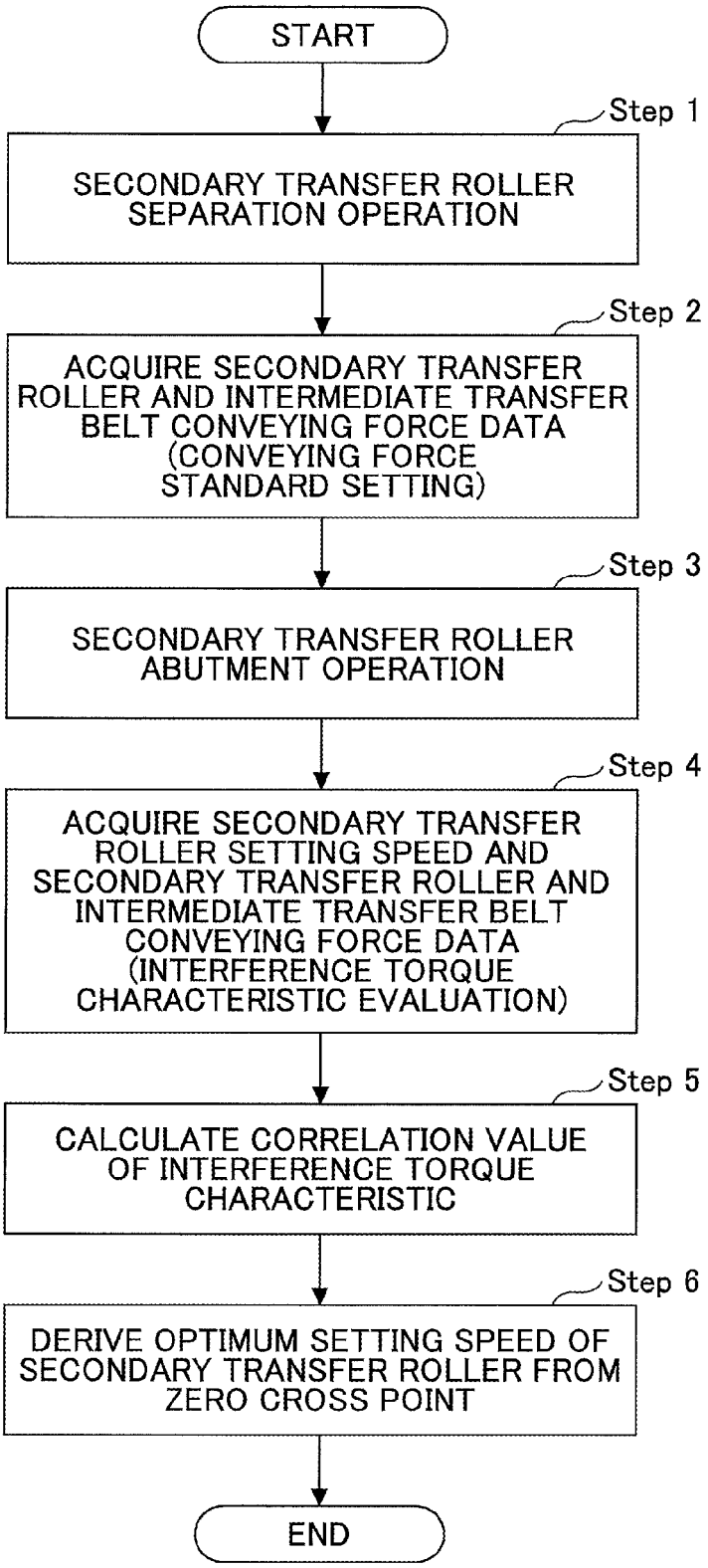
FIG. 17 is a flowchart of a process of deriving the optimum value of the set speed of the secondary transfer roller.

FIG. 17 is a flowchart of a process of deriving the optimum value of the secondary transfer roller set speed. The present operation is performed at an initializing operation executed when the power of the image forming apparatus is turned on. Furthermore, the method may be continuously performed at the time of the image output operation.

First, a separation operation of separating the secondary transfer roller 7 from the intermediate transfer belt 5 is performed, and the intermediate transfer belt 5 is drivingly controlled by a standard speed instruction value at the time of image forming, and furthermore, the secondary transfer roller 7 is drivingly controlled at a default speed. In the case of the initial stage of device operation when there is no default speed profile, a constant value is used as the profile to execute the following deriving process (step 1). Next, when the secondary transfer roller 7 and the intermediate transfer belt 5 are in a separated state, the conveying force transition data of the driving motors of the secondary transfer roller 7 and the intermediate transfer belt 5 is acquired. According to need, a low pass filter process is performed on the conveying force transition data. The value of this conveying force is set as the standard conveying force at the time of monolithic driving (step 2). Subsequently, an abutment operation of causing the secondary transfer roller 7 to abut the intermediate transfer belt 5 is performed (step 3). Then, an interference torque characteristic evaluation is performed (step 4). Note that the interference torque characteristic is obtained by driving the secondary transfer roller 7 while changing the set speed of the secondary transfer roller 7 into a sinusoidal waveform, and calculating the variation amount from the standard conveying force ahead of the conveying force waveform of the secondary transfer roller 7 and the intermediate transfer belt 5 at this time. Then, by using a low pass filter, the components having the same period as the sinusoidal wave are extracted, and are set as the interference torque characteristics.

Next, the correlation coefficient of the two data items of the interference torque transition data (FIG. 15B) of the secondary transfer roller 7 and the intermediate transfer belt 5 are calculated, and it is confirmed whether the two data items have an inverse correlation characteristic (step 5). When the correlation coefficient is negative, it is determined as an inverse correlation, and the process proceeds to the next step; however, when the correlation coefficient is positive, the next step is not performed, and the control process of deriving a secondary transfer set speed is ended. When the contact friction between the secondary transfer roller 7 and the intermediate transfer belt 5 is significantly low, and the secondary transfer roller 7 and the intermediate transfer belt 5 completely slip on each other, an inverse correlation will not be seen. In this state, the sheet conveying operation tends to become unstable, and therefore error information is sent to the image forming apparatus main unit. Furthermore, when the secondary transfer roller 7 abuts the intermediate transfer belt 5, there are cases where the bearing part and the roller part deform excessively, and the load torque increases at both the secondary transfer roller 7 and the intermediate transfer belt 5. In this case, the correlation coefficient becomes positive, and this is also reported as a failure to the image forming apparatus by error information. The optimum set speed of the secondary transfer roller 7 is derived from the zero cross point, and the default speed is changed to the optimum value (step 6). This optimum value represents a state where the surface speeds of the secondary transfer roller 7 and the intermediate transfer belt 5 match each other, and the interference torque is zero. However, in the secondary transfer process, when the transfer rate can be increased by setting a slight amount of interference torque, a default offset value may be added to the optimum value. A transfer rate is an index indicating how much of the toner amount on the intermediate transfer belt 5 has been transferred onto the sheet. It is known that when there is a slight difference in the surface speed, the toner can be transferred more easily by the friction between the sheet and the intermediate transfer belt 5.

Figure 18:
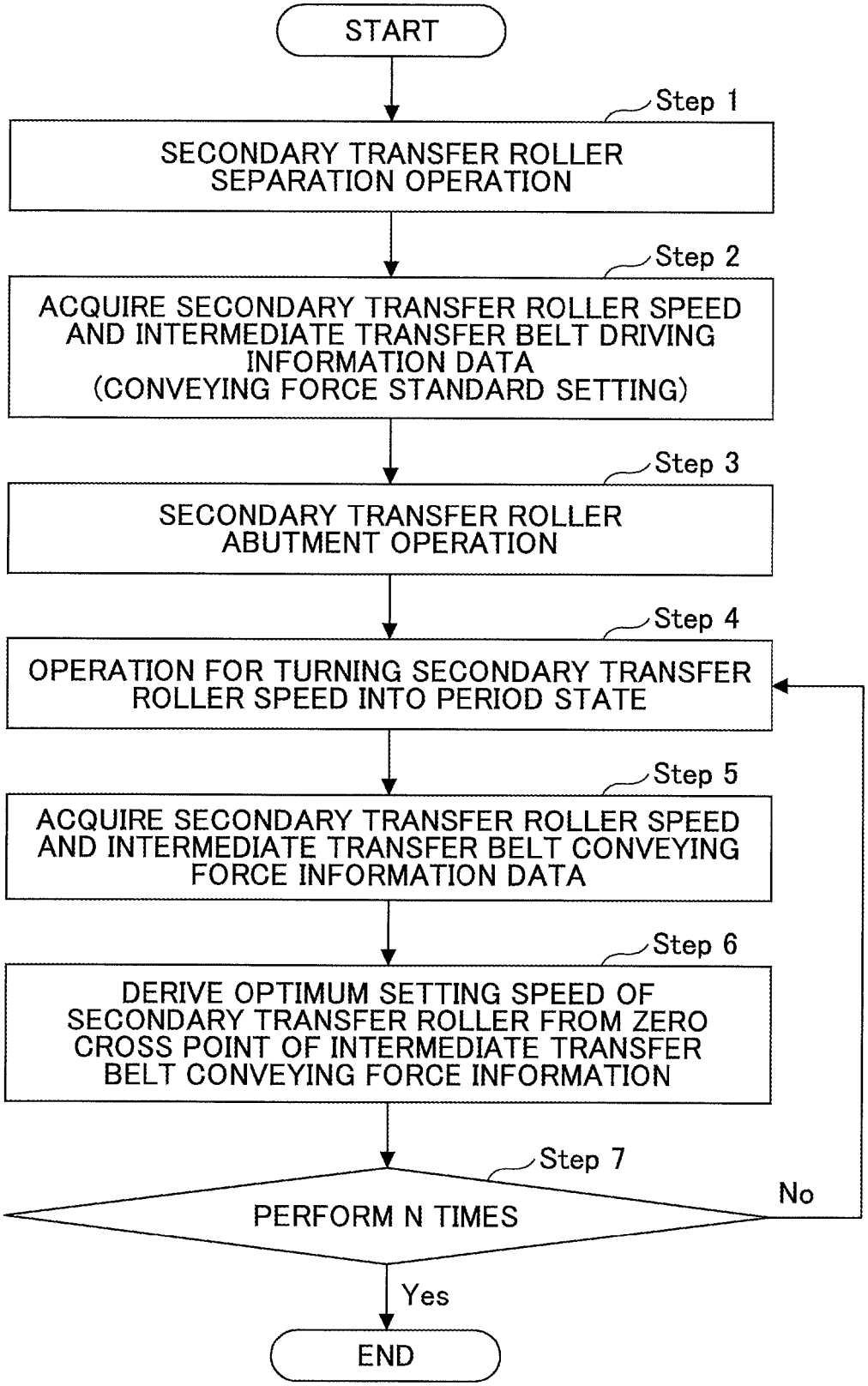
FIG. 18 is a flowchart of a process of deriving the speed setting of the secondary transfer roller.

FIG. 18 is a flowchart of a process of deriving the speed setting of the secondary transfer roller 7 illustrated in FIGS. 15A and 15B. The present operation is performed at an initializing operation executed when the power of the image forming apparatus is turned on. Furthermore, the method may be continuously performed at the time of the image output operation.

First, a separation operation of separating the secondary transfer roller 7 from the intermediate transfer belt 5 is performed, and the intermediate transfer belt 5 is drivingly controlled by a standard speed instruction value at the time of image forming, and furthermore, the secondary transfer roller 7 is drivingly controlled at a default speed (step 1). Next, when the secondary transfer roller 7 and the intermediate transfer belt 5 are in a separated state, the secondary transfer roller speed and the driving conveying force transition data of the intermediate transfer belt 5 are acquired. According to need, a low pass filter process is performed on the conveying force transition data. The value of this conveying force is set as the standard conveying force at the time of monolithic driving (step 2). Subsequently, an abutment operation of causing the secondary transfer roller 7 to abut the intermediate transfer belt 5 is performed (step 3). Then, the secondary transfer roller 7 is driven such that the set speed of the secondary transfer roller 7 becomes periodic (step 4), and the secondary transfer roller speed when driving is performed in step 4 and the drive conveying force transition data of the intermediate transfer belt 5 are acquired (step 5). Then, a low pass filter process is performed on the conveying set speed of the secondary transfer roller 7 is derived from the zero cross point, and the default speed is changed to the optimum value (step 6). The zero cross point is the intersection point where the standard conveying force at the time of driving motor monolithic driving of the intermediate transfer belt 5 of step 2 and the driving conveying force transition data of the intermediate transfer belt 5 of step 5 match each other. The optimum value of the secondary transfer roller speed represents a state where the surface speed of the secondary transfer roller 7 and the surface speed of the intermediate transfer belt 5 match each other, and the interference torque of the intermediate transfer belt 5 is zero. However, in the secondary transfer process, when the transfer rate can be increased by setting a slight amount of interference torque, a default offset value may be added to the optimum value. Next, it is determined whether the adjustment of step 4 through step 6 has been performed an N number of times (step 7). When the adjustment has not been performed an N number of times (No in step 7), the adjustment of step 4 through step 6 is performed again. When the adjustment has been performed an N number of times (Yes in step 7), the flowchart is completed at step 7.

Figure 19:
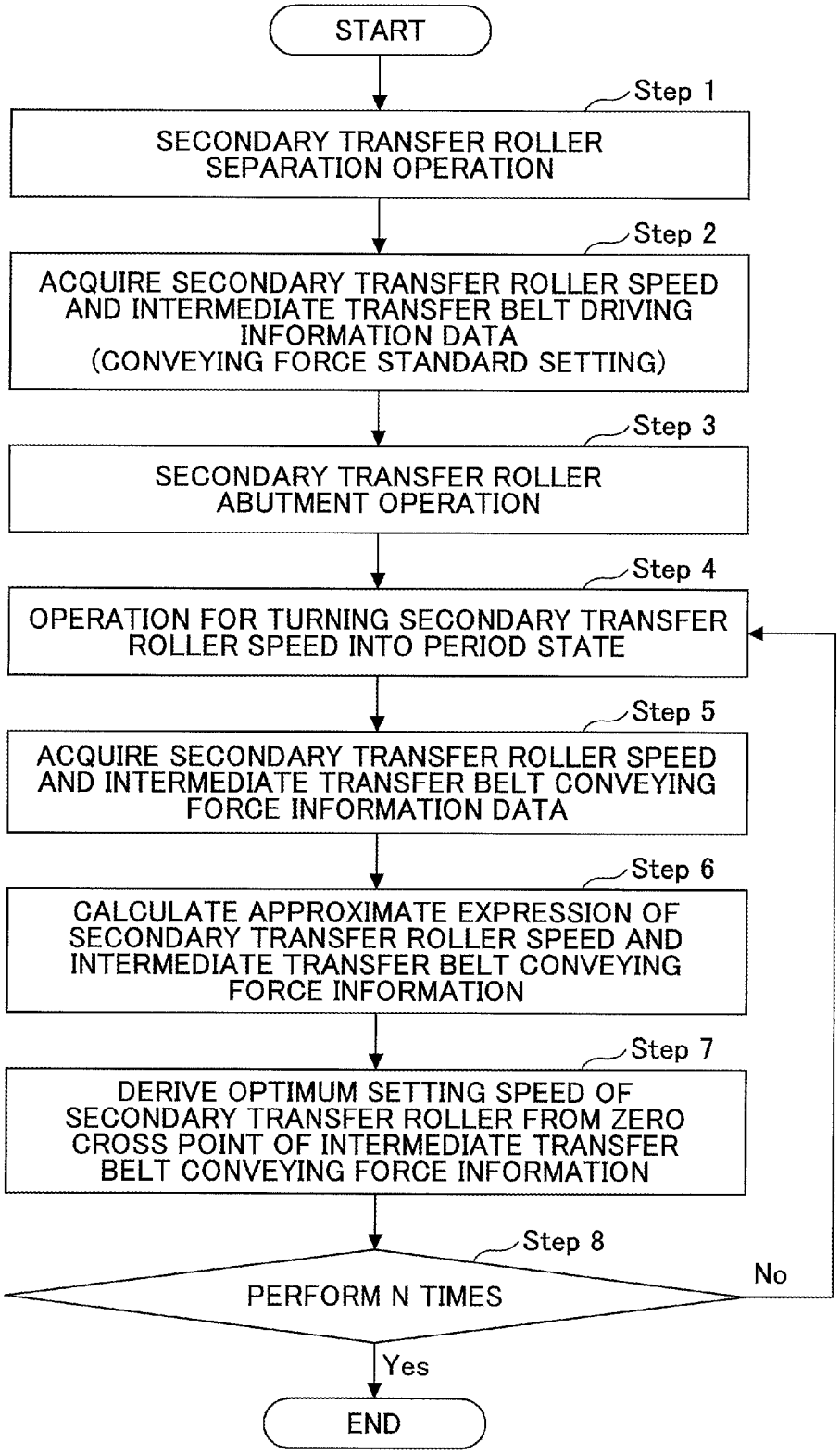
FIG. 19 is a flowchart of a method using an approximation formula which is a method of deriving the speed setting of the secondary transfer roller.

FIG. 19 is a flowchart of a method using an approximation formula which is a method of deriving the speed setting of the secondary transfer roller 7 illustrated in FIGS. 15A and 15B. FIG. 19 is the same as the flowchart of FIG. 18 in steps 1 through 5, and therefore only the differences from step 6 and onward are described.

An approximation formula of the secondary transfer roller speed and the intermediate transfer belt driving conveying force is calculated (step 6). The optimum set speed of the secondary transfer roller 7 is derived from the zero cross point, and the default speed is changed to the optimum value (step 7). The zero cross point is the intersection point where the standard conveying force at the time of driving motor monolithic driving of the intermediate transfer belt 5 of step 2 and the approximation formula of the driving conveying force of the intermediate transfer belt 5 of step 6 match each other. The optimum value of the secondary transfer roller speed represents a state where the surface speed of the secondary transfer roller 7 and the surface speed of the intermediate transfer belt 5 match each other, and the interference torque of the intermediate transfer belt 5 is zero. However, in the secondary transfer process, when the transfer rate can be increased by setting a slight amount of interference torque, a default offset value may be added to the optimum value. Next, it is determined whether the adjustment of step 4 through step 7 has been performed an N number of times (step 8). When the adjustment has not been performed an N number of times (No in step 8), the adjustment of step 4 through step 7 is performed again. When the adjustment has been performed an N number of times (Yes in step 8), the flowchart is completed at step 8.

The above describes examples, and the present invention has unique effects in each of the following aspects.

(Aspect A)

A transfer device includes an endless belt image bearer such as the intermediate transfer belt 5 which is rotatably stretched around a plurality of stretching members; a driving roller such as the driving roller 10 configured to drivingly rotate the belt image bearer, the driving roller being one of the plurality of stretching members; a first driving motor such as the intermediate transfer driving motor 17 configured to drivingly rotate the driving roller; a first speed detecting unit such as the belt encoder sensor 15 configured to detect a rotational speed of the belt image bearer; a rotatable transfer member such as the secondary transfer roller 7 configured to abut an outer peripheral surface of the belt image bearer and form a transfer nip, wherein an image borne on the outer peripheral surface of the belt image bearer is transferred onto a transfer material such as a sheet that is sandwiched in the transfer nip; a second driving motor such as the secondary transfer driving motor 42 configured to drivingly rotate the transfer member; a second speed detecting unit such as the secondary transfer roller encoder 26 configured to detect a rotational speed of the transfer member; a contact separation unit configured to cause the belt image bearer and the transfer member to contact and separate from each other; a relative speed setting unit configured to obtain and set a relative speed, such that a variation amount is less than a predetermined variation amount, the variation amount being an amount of variation of a value relating to a driving torque of the first driving motor and a value relating to a driving torque of the second driving motor in a second state in which the belt image bearer and the transfer member are caused to contact each other by the contact separation unit, with respect to a value relating to the driving torque of the first driving motor and a value relating to the driving torque of the second driving motor in a first state in which the belt image bearer and the transfer member are caused to separate from each other by the contact separation unit; and a control unit such as the motor control unit 20 configured to control at least one of the first driving motor and the second driving motor such that the belt image bearer and the transfer member are rotated at rotational speeds corresponding to the relative speed set by the relative speed setting unit.

In (Aspect A), first, in a first state in which the belt image bearer and the transfer member are separated, a value relating to the driving torque of the first driving motor and a value relating to the driving torque of the second driving motor are obtained. Next, in a second state in which the belt image bearer and the transfer member are in contact, a value relating to the driving torque of the first driving motor and a value relating to the driving torque of the second driving motor are obtained. Then, the relative speed setting unit obtains and sets a relative speed, such that a variation amount is less than a predetermined variation amount. The variation amount is an amount of variation of the values relating to the driving torques of the first driving motor and the second driving motor in the second state, with respect to the values relating to the driving torques of the first driving motor and the second driving motor in the first state. Then, the belt image bearer and the transfer member are rotated at a rotational speed corresponding to the relative speed set by the relative speed setting unit. Accordingly, in the second state, the belt image bearer and the transfer member can be rotated at a rotational speed that can attain the relative speed such that the values relating to the driving torques of the first driving motor and the second driving motor become close to those of the first state as much as possible. Thus, it is possible to reduce the interference torque of the first driving motor and the second driving motor in the second state, and the movement speed of the belt image bearer can be controlled with high precision by the first driving motor. Therefore, it is possible to improve the stability in drivingly rotating the belt image bearer and in conveying a transfer material at the transfer nip.

(Aspect B)

The transfer device according to aspect A, further including a first driving torque estimating unit such as the main control unit 44 configured to estimate a first driving torque applied on the first driving motor; and a second driving torque estimating unit such as the main control unit 44 configured to estimate a second driving torque applied on the second driving motor, wherein the value relating to the driving torque of the first driving motor and the value relating to the driving torque of the second driving motor in the first state are respectively the first driving torque and the second driving torque applied when the belt image bearer and the transfer member are rotated at a constant speed in the first state, which are estimated by the first driving torque estimating unit and the second driving torque estimating unit, and the value relating to the driving torque of the first driving motor and the value relating to the driving torque of the second driving motor in the second state are respectively the first driving torque and the second driving torque applied when the belt image bearer and the transfer member are rotated at a constant speed in the second state, which are estimated by the first driving torque estimating unit and the second driving torque estimating unit.

In (Aspect B), first, in the first state where the belt image bearer and the transfer member are separated, an estimation value of a first driving torque and an estimation value of a second driving torque are obtained, in a state where the belt image bearer and the transfer member are rotated at a constant speed. The obtained estimation value of the first driving torque and the estimation value of the second driving torque are set as target torque estimation values of the present state to which the individual differences (tolerance) of the belt image bearer and the transfer member, the environment, and time-dependent variations are reflected. Next, in a state where the belt image bearer and the transfer member are in contact, the estimation value of the first driving torque and the estimation value of the second driving torque are obtained, when the belt image bearer and the transfer member are rotated while changing the relative speed of the belt image bearer and the transfer member. Then, the relative speed is obtained, such that a variation amount is less than the predetermined variation amount. The variation amount is an amount of variation of the estimation value of the first driving torque and the estimation value of the second driving torque in the second state, with respect to the estimation value of the first driving torque and the estimation value of the second driving torque in the first state. Then, the belt image bearer and the transfer member are rotated at a rotational speed that can attain the relative speed in the second state. Accordingly, in the second state, the belt image bearer and the transfer member can be rotated at a rotational speed that can attain the relative speed such that the estimation value of the first driving torque and the estimation value of the second driving torque become close to those of the first state as much as possible. Thus, it is possible to reduce the interference torque of the first driving motor and the second driving motor in the second state, and the movement speed of the belt image bearer can be controlled with high precision by the first driving motor. Therefore, it is possible to improve the stability in drivingly rotating the belt image bearer and in conveying a transfer material at the transfer nip.

(Aspect C)

The transfer device according to aspect A, wherein the value relating to the driving torque is at least one of a motor current value, a motor control voltage, a motor control voltage instruction value, and a motor PWM signal value. Accordingly, as described in the above embodiment, the driving can be adjusted by using these values as indexes, similar to the load torque (torque measurement value, torque estimation value).

(Aspect D)

The transfer device according to aspects A through C, wherein the relative speed setting unit sets the relative speed a plurality of times. Accordingly, as described in the above embodiment, the adjustment precision can be increased.

(Aspect E)

The transfer device according to aspect B or D, wherein the first driving torque estimating unit can estimate the first driving torque based on a drive instruction value of the first driving motor and a detection result of the first speed detecting unit, and the second driving torque estimating unit can estimate the second driving torque based on a drive instruction value of the second driving motor and a detection result of the second speed detecting unit.

(Aspect F)

The transfer device according to aspects A through E, wherein the relative speed of the belt image bearer and the transfer member is changed into a period waveform such as a sinusoidal wave or a triangular wave in the second state, and the belt image bearer and the transfer member are rotated. Accordingly, as described in the above embodiment, although the first driving torque and the second driving torque include load torque variation, the interference torque can be determined with high precision from the correlation with the period waveform such as a sinusoidal wave or a triangular wave.

(Aspect G)

The transfer device according to aspects A through F, further including a rotatable first drive transmitting member configured to transmit a drive to the driving roller from the first driving motor; and a rotatable second drive transmitting member configured to transmit a drive to the transfer member from the second driving motor, wherein in the second state, the relative speed of the belt image bearer and the transfer member is changed into the period waveform such as a sinusoidal wave or a triangular wave having a longer period than a rotation period of a relative speed of the belt image bearer, the transfer member, the first drive transmitting member, and the second drive transmitting member. Accordingly, as described in the above embodiment, the interference torque components can be extracted separately from the torque variation of other rotation periods.

(Aspect H)

The transfer device according to aspect F or G, further including a variation of an estimation value of the first driving torque and an estimation value of the second driving torque in the second state, with respect to an estimation value of the first driving torque and an estimation value of the second driving torque in the first state is measured, a result of the measured variation is approximated into the period waveform, and the relative speed is obtained based on a result of the approximation such that the variation amount of the estimation value of the first driving torque and the estimation value of the second driving torque is less than the predetermined variation amount. Accordingly, as described in the above embodiment, the minimum variation amount can be easily obtained by the zero cross point; however, the precision increases by determining the zero cross point from the entire data by approximating the variation to the period waveform.

(Aspect I)

The transfer device according to aspect B and aspects D through H, wherein a correlation coefficient of the belt image bearer and the transfer member is derived from a transition of a variation amount of an estimation value of the first driving torque and an estimation value of the second driving torque in the second state, with respect to an estimation value of the first driving torque and an estimation value of the second driving torque in the first state, and when the correlation coefficient indicates an inverse correlation, the relative speed is obtained such that the variation amount is less than the predetermined variation amount. Accordingly, as described in the above embodiment, in a state where there is no interference torque at all, a peculiar speed setting can be avoided.

(Aspect J)

The transfer device according to aspects A through I, wherein the control unit controls at least one of the first driving motor and the second driving motor such that the belt image bearer and the transfer member are rotated at rotational speeds that attain a relative speed which is obtained by adding a default relative speed to the relative speed at which the variation amount is less than the predetermined variation amount. Accordingly, as described in the above embodiment, an optimum value having high a transfer rate can be set.

(Aspect K)

The transfer device according to aspects A through J, wherein the predetermined variation amount is within plus or minus five percent of an estimation value of the first driving torque and an estimation value of the second driving torque in the first state. Accordingly, as described in the above embodiment, variations in the speed of the belt image bearer caused by the interference torque can be reduced.

(Aspect L)

The transfer device according to aspect B and aspects D through K, wherein a phase lag amount is calculated, which is the phase lag amount of a variation of a driving torque estimation value estimated by the first driving torque estimating unit or the second driving torque estimating unit, with respect to a phase obtained changing the relative speed of the belt image bearer and the transfer member into a sinusoidal waveform, and when a variation of the relative speed and a variation of the driving torque estimation value occur simultaneously, a relative speed is derived, at which a variation amount of the driving torque estimation value is small with respect to an estimation value of the first driving torque or an estimation value of the second driving torque in the first state. Accordingly, as described in the above embodiment, even when the torque variation repose of the soft type transfer member is delayed due to a shear deformation, an optimum set speed of the transfer member can be accurately derived by sinusoidal wave modulation in a short time.

(Aspect M)

An image forming apparatus such as a printer including a toner image forming unit configured to form a toner image; a belt image bearer such as the intermediate transfer belt 5 configured to bear the toner image formed by the toner image forming unit; and a transfer unit such as an intermediate transfer device configured to transfer the toner image from the belt image bearer to a transfer material, wherein the transfer device according to aspects A through L is used as the transfer unit. Accordingly, as described in the above embodiment, the stability in driving a belt image bearer and in conveying a transfer material can be improved, and favorable image forming can be performed.

(Aspect N)

A program that is read and executed by a transfer device to execute a process, the transfer device being controlled to transfer an image, which is borne on a peripheral surface of a belt image bearer such as the intermediate transfer belt 5 rotatably stretched around a plurality of stretching members including a driving roller such as the driving roller 10, onto a transfer material such as a sheet sandwiched in a transfer nip formed by causing the belt image bearer and a transfer member such as the secondary transfer roller 7 to abut each other, wherein the process includes a process of obtaining and setting, by a relative speed setting unit, a relative speed of the belt image bearer and the transfer member, such that a variation amount is less than a predetermined variation amount, the variation amount being an amount of variation of a value relating to a driving torque of a first driving motor such as the intermediate transfer driving motor 17, which drivingly rotates the driving roller, and a value relating to a driving torque of a second driving motor such as the secondary transfer driving motor 42, which drivingly rotates the transfer member, in a second state in which the belt image bearer and the transfer member are caused to contact each other by a contact separation unit, with respect to a value relating to the driving torque of the first driving motor and a value relating to the driving torque of the second driving motor in a first state in which the belt image bearer and the transfer member are caused to separate from each other by the contact separation unit, and a process of controlling, by a control unit such as the motor control unit 20, at least one of the first driving motor and the second driving motor such that the belt image bearer and the transfer member are rotated at rotational speeds corresponding to the relative speed set by the relative speed setting unit. Accordingly, as described in the above embodiment, the stability in driving a belt image bearer and in conveying a transfer material can be improved.

According to one embodiment of the present invention, a transfer device and an image forming apparatus are provided, which are capable of improving the stability in driving a belt image bearer and in conveying a transfer material.

The transfer device and the image forming apparatus are not limited to the specific embodiments described herein, and variations and modifications may be made without departing from the spirit and scope of the present invention.

The present application is based on and claims the benefit of priority of Japanese Priority Patent Application No. 2015-011633, filed on Jan. 23, 2015, and Japanese Priority Patent Application No. 2015-134777, filed on Jul. 3, 2015, the entire contents of which are hereby incorporated herein by reference.

What is claimed is:

1. A non-transitory computer-readable recording medium storing a program that causes a computer that constitutes a transfer device to execute a process, the transfer device being controlled to transfer an image, which is borne on a peripheral surface of a belt image bearer rotatably stretched around a plurality of stretching members including a driving roller, onto a transfer material sandwiched in a transfer nip formed by causing the belt image bearer and a transfer member to abut each other, the process comprising:

setting, via a relative speed setting unit, a first relative speed of the belt image bearer and the transfer member by changing a relative speed of the belt image bearer and the transfer member into a periodic waveform in a first state in which the belt image bearer and the transfer member are in contact with each other; and controlling at least one of the first driving motor and the second driving motor such that the belt image bearer and the transfer member are rotated at the first relative speed set by the relative speed setting unit.

2. A motor control device for controlling a first driving motor configured to drivingly rotate a belt image bearer and a second driving motor configured to drivingly rotate a transfer member, the motor control device comprising:

a controller configured to:

set, via a relative speed setting unit, a first relative speed of the belt image bearer and the transfer member by changing a relative speed of the belt image bearer and the transfer member into a periodic waveform in a first state in which the belt image bearer and the transfer member are in contact with each other; and control at least one of the first driving motor and the second driving motor such that the belt image bearer and the transfer member are rotated at the first relative speed set by the relative speed setting unit.

3. The motor control device according to claim 2, wherein the relative speed setting unit is configured to obtain the relative speed of the belt image bearer and the transfer member such that a variation amount of a value relating to a driving torque of the first driving motor or a variation amount of a value relating to a driving torque of the second driving motor is less than a predetermined variation amount, when changing from a second state, in which the belt image bearer and the transfer member are caused to separate from each other by a contact separation unit, to the first state, or when changing from the first state to the second state, and set the obtained relative speed as the first relative speed.

4. A transfer device including the motor control device according to claim 2.

5. The transfer device according to claim 4, the transfer device comprising:

an endless belt image bearer which is rotatably stretched around a plurality of stretching members;

a driving roller configured to drivingly rotate the belt image bearer, the driving roller being one of the plurality of stretching members;

a first driving motor configured to drivingly rotate the driving roller;

a first speed detector configured to detect a rotational speed of the belt image bearer;

a rotatable transfer member configured to abut an outer peripheral surface of the belt image bearer and form a transfer nip, wherein an image borne on the outer peripheral surface of the belt image bearer is transferred onto a transfer material that is sandwiched in the transfer nip;

a second driving motor configured to drivingly rotate the transfer member;

a second speed detector configured to detect a rotational speed of the transfer member; and a contact separation unit configured to cause the belt image bearer and the transfer member to contact and separate from each other.

6. The transfer device according to claim 5, wherein the controller further configured to:

estimate, via a first driving torque estimating unit, a first driving torque applied on the first driving motor; and estimate, via a second driving torque estimating unit, a second driving torque applied on the second driving motor, wherein a value relating to a driving torque of the first driving motor and a value relating to a driving torque of the second driving motor in a first state are respectively the first driving torque and the second driving torque applied when the belt image bearer and the transfer member are rotated at constant speeds in the first state, which are estimated by the first driving torque estimating unit and the second driving torque estimating unit, and a value relating to a driving torque of the first driving motor and a value relating to a driving torque of the second driving motor in a second state are respectively the first driving torque and the second driving torque applied when the belt image bearer and the transfer member are rotated at constant speeds in the second state, which are estimated by the first driving torque estimating unit and the second driving torque estimating unit.

7. The transfer device according to claim 6, wherein the value relating to the driving torque is at least one of a motor current value, a motor control voltage, a motor control voltage instruction value, and a motor PWM signal value.

8. The transfer device according to claim 6, wherein the first driving torque estimating unit is configured to estimate the first driving torque based on a drive instruction value of the first driving motor and a detection result of the first speed detector, and the second driving torque estimating unit is configured to estimate the second driving torque based on a drive instruction value of the second driving motor and a detection result of the second speed detector.

9. The transfer device according to claim 6, further comprising:

a rotatable first drive transmitting member configured to transmit a drive to the driving roller from the first driving motor; and a rotatable second drive transmitting member configured to transmit a drive to the transfer member from the second driving motor, wherein in the second state, the relative speed of the belt image bearer and the transfer member is changed into the periodic waveform having a longer period than a rotation period of a relative speed of the belt image bearer, the transfer member, the first drive transmitting member, and the second drive transmitting member.

10. The transfer device according to claim 6, wherein the controller is further configured to:

obtain a variation of an estimation value of the first driving torque and an estimation value of the second driving torque in the second state, with respect to an estimation value of the first driving torque and an estimation value of the second driving torque in the first state is measured, a result of the measured variation is approximated into the periodic waveform, and the first relative speed is obtained based on a result of the approximation such that the variation amount of the estimation value of the first driving torque and the estimation value of the second driving torque is less than the predetermined variation amount.

11. The transfer device according to claim 6, wherein a correlation coefficient of the belt image bearer and the transfer member is derived from a transition of a variation amount of an estimation value of the first driving torque and an estimation value of the second driving torque in the second state, with respect to an estimation value of the first driving torque and an estimation value of the second driving torque in the first state, and when the correlation coefficient indicates an inverse correlation, the first relative speed is obtained such that the variation amount is less than the predetermined variation amount.

12. The transfer device according to claim 6, wherein the predetermined variation amount is within plus or minus five percent of an estimation value of the first driving torque and an estimation value of the second driving torque in the first state.

13. The transfer device according to claim 6, wherein the controller is further configured to:

calculate a phase lag amount, which is the phase lag amount of a variation of a driving torque estimation value estimated by the first driving torque estimating unit or the second driving torque estimating unit, with respect to a phase obtained changing the relative speed of the belt image bearer and the transfer member into a sinusoidal waveform, and when a variation of the first relative speed and a variation of the driving torque estimation value occur simultaneously, a relative speed is derived, at which a variation amount of the driving torque estimation value is small with respect to an estimation value of the first driving torque or an estimation value of the second driving torque in the first state.

14. The transfer device according to claim 5, wherein the relative speed setting unit is configured to set the relative speed a plurality of times.

15. The transfer device according to claim 5, wherein the controller is configured to control at least one of the first driving motor and the second driving motor such that the belt image bearer and the transfer member are rotated at rotational speeds that attain a relative speed which is obtained by adding a default relative speed to the first relative speed at which the variation amount is less than the predetermined variation amount.

16. The transfer device according to claim 5, wherein the first driving motor controls a rotational speed of the driving roller such that a movement speed of the belt image bearer becomes a predetermined speed, based on a detection result of the first speed detector and a detection result of the second speed detector.

17. An image forming apparatus comprising:

a toner image forming unit configured to form a toner image;

a belt image bearer configured to bear the toner image formed by the toner image forming unit; and a transfer unit configured to transfer the toner image from the belt image bearer to a transfer material, wherein the transfer device according to claim 5 is used as the transfer unit.

18. A method for controlling a first driving motor configured to drivingly rotate a belt image bearer and a second driving motor configured to drivingly rotate a transfer member, the method comprising:

setting, via a relative speed setting unit, a first relative speed of the belt image bearer and the transfer member by changing a relative speed of the belt image bearer and the transfer member into a periodic waveform in a first state in which the belt image bearer and the transfer member are in contact with each other; and controlling at least one of the first driving motor and the second driving motor such that the belt image bearer and the transfer member are rotated at the first relative speed set by the relative speed setting unit.

* * * * *